US009151480B2

(12) United States Patent
Mostoller et al.

(10) Patent No.: US 9,151,480 B2
(45) Date of Patent: Oct. 6, 2015

(54) LIGHT BULB ASSEMBLY

(71) Applicant: Tyco Electronics Corporation, Berwyn, PA (US)

(72) Inventors: Matthew Edward Mostoller, Hummelstown, PA (US); Christopher George Daily, Harrisburg, PA (US); Ronald Martin Weber, Annville, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 133 days.

(21) Appl. No.: 14/015,215

(22) Filed: Aug. 30, 2013

(65) Prior Publication Data

US 2015/0062928 A1 Mar. 5, 2015

(51) Int. Cl.

| | |
|---|---|
| ***F21V 23/06*** | (2006.01) |
| ***F21K 99/00*** | (2010.01) |
| ***F21V 21/002*** | (2006.01) |
| ***F21V 23/00*** | (2015.01) |
| ***H01R 33/22*** | (2006.01) |
| *F21V 3/00* | (2015.01) |
| *F21Y 101/02* | (2006.01) |

(52) U.S. Cl.

CPC . *F21V 23/06* (2013.01); *F21K 9/00* (2013.01); *F21K 9/1355* (2013.01); *F21K 9/90* (2013.01); *F21V 21/002* (2013.01); *F21V 23/005* (2013.01); *H01R 33/225* (2013.01); *F21V 3/00* (2013.01); *F21Y 2101/02* (2013.01)

(58) Field of Classification Search

USPC ..... 362/249.02, 311.02, 254, 800, 650

See application file for complete search history.

(56) References Cited

U.S. PATENT DOCUMENTS

| | | | | |
|---|---|---|---|---|
| 7,892,031 | B1 * | 2/2011 | Mostoller et al. | 439/611 |
| 8,058,782 | B2 * | 11/2011 | Lai | 313/46 |
| 2009/0295268 | A1 | 12/2009 | Peng | |
| 2010/0046222 | A1 * | 2/2010 | Yang | 362/249.02 |
| 2010/0277918 | A1 * | 11/2010 | Chen et al. | 362/249.02 |
| 2013/0063945 | A1 * | 3/2013 | Wu et al. | 362/249.02 |
| 2013/0107521 | A1 * | 5/2013 | Hisayasu et al. | 362/235 |
| 2013/0128573 | A1 | 5/2013 | Leung et al. | |
| 2015/0062929 | A1 * | 3/2015 | Mostoller et al. | 362/363 |

FOREIGN PATENT DOCUMENTS

| | | | |
|---|---|---|---|
| EP | 2 579 392 | A1 | 4/2013 |
| WO | 2013/148239 | A1 | 10/2013 |

OTHER PUBLICATIONS

International Search Report, International Application No. PCT/US2014/052802, International Filing Date, Aug. 27, 2014.

* cited by examiner

*Primary Examiner* — Laura Tso

(57) ABSTRACT

A light bulb assembly includes a bulb housing that is configured to be connected to a light bulb socket. A light bulb is held by the bulb housing and includes a printed circuit board (PCB). The assembly includes an electrical connector having a connector housing, a negative terminal of the light bulb assembly, and a positive terminal of the light bulb assembly. The electrical connector is mounted to the PCB such that the positive terminal and the negative terminal are electrically connected to the PCB. The negative terminal is configured to mate with a corresponding negative terminal of the light bulb socket. The positive terminal is configured to mate with a corresponding positive terminal of the light bulb socket.

20 Claims, 16 Drawing Sheets

LIGHT BULB ASSEMBLY

BACKGROUND OF THE INVENTION

The subject matter described and/or illustrated herein relates generally to light bulb assemblies.

Light bulb assemblies typically include a light bulb mounted to a standard base. For example, the light bulb may be mounted to an Edison screw base that is configured to be threadably connected to a complementary light bulb socket or a bayonet base that is configured to connect to a complementary light bulb socket with a bayonet style connection. The base includes a shell that defines a negative terminal of the light bulb assembly. The base also includes a positive terminal of the light bulb assembly. When the shell is connected to the light bulb socket, the negative terminal provided by the shell and the positive terminal mate with respective negative and positive terminals of the light bulb socket to electrically connect the light bulb assembly to the light bulb socket.

At least some types of light bulbs include a printed circuit board (PCB) that provides electrical power and/or other electrical pathways between the light bulb and the base. For example, light emitting diode (LED) light bulbs and compact fluorescent lamp (CFL) light bulbs include PCBs. The PCB of the light bulb is electrically connected to the positive and negative terminals of the base through electrical wires that are soldered to the positive terminal and the shell of the base. But, the soldering operations used to solder the electrical wires to the positive terminal and the shell may be time consuming, which may increase the cost of the light bulb assembly and/or may reduce the number of light bulb assemblies that can be manufactured over a given period of time. Moreover, the soldering operations used to solder the electrical wires to the positive terminal and the shell of the base may result in quality defects in the light bulb assembly, for example because of machine and/or human error when performing the soldering operations.

BRIEF DESCRIPTION OF THE INVENTION

In an embodiment, a light bulb assembly includes a bulb housing that is configured to be connected to a light bulb socket. A light bulb is held by the bulb housing and includes a printed circuit board (PCB). The assembly includes an electrical connector having a connector housing, a negative terminal of the light bulb assembly, and a positive terminal of the light bulb assembly. The electrical connector is mounted to the PCB such that the positive terminal and the negative terminal are electrically connected to the PCB. The negative terminal is configured to mate with a corresponding negative terminal of the light bulb socket. The positive terminal is configured to mate with a corresponding positive terminal of the light bulb socket.

In an embodiment, a light bulb assembly includes a bulb housing that is configured to be connected to a light bulb socket, and a positive terminal configured to be held by the bulb housing. The positive terminal is configured to mate with a corresponding positive terminal of the light bulb socket. A light bulb is held by the bulb housing and includes a printed circuit board (PCB). The light bulb assembly includes an electrical connector having a connector housing, a positive contact held by the connector housing, and a negative terminal held by the connector housing. The electrical connector is mounted to the PCB such that the positive contact and the negative terminal are electrically connected to the PCB. The positive contact is configured to mate with the positive terminal and the negative terminal is configured to mate with a corresponding negative terminal of the light bulb socket.

In an embodiment, a light bulb assembly includes a bulb housing that is configured to be connected to a light bulb socket. A light bulb is held by the bulb housing and includes a printed circuit board (PCB). A negative terminal is mounted to the PCB such that the negative terminal is electrically connected to the PCB. The negative terminal is configured to mate with a corresponding negative terminal of the light bulb socket. The assembly includes a positive terminal that extends a length from a mounting end to a mating end. The mounting end is mounted to the PCB to electrically connect the positive terminal to the PCB. The mating end is configured to mate with a corresponding positive terminal of the light bulb socket.

DETAILED DESCRIPTION OF THE INVENTION

Figure 1:
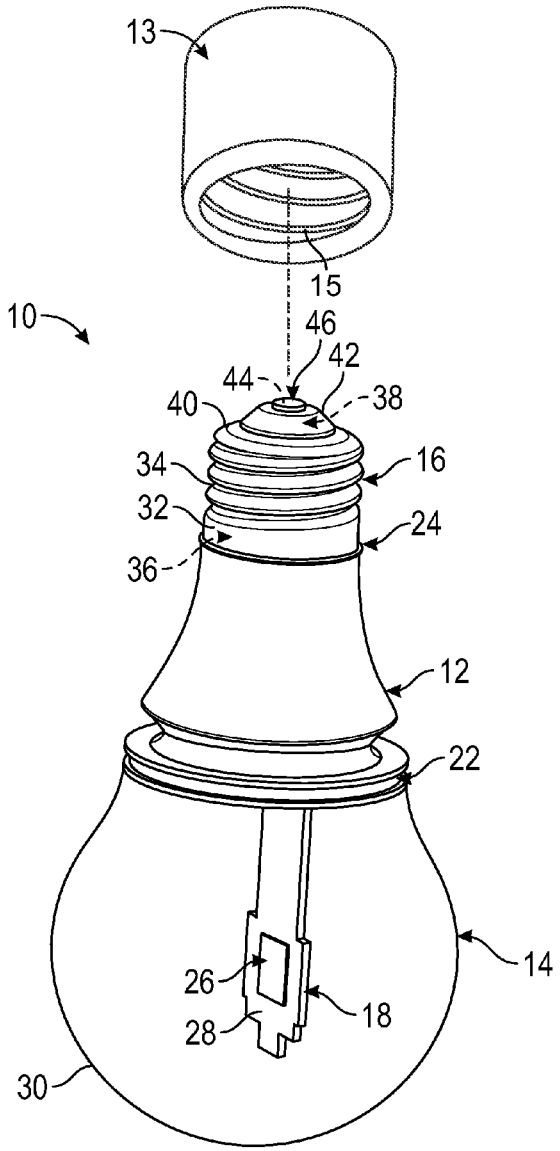
FIG. 1 is a perspective view of an embodiment of a light emitting diode (LED) bulb assembly.

FIG. 1 is a perspective view of an embodiment of a light bulb assembly 10. In the illustrated embodiment, the light bulb assembly 10 is a light emitting diode (LED) light bulb assembly 10 that includes a bulb housing 12, an LED bulb 14 held by the bulb housing 12, and a screw base 16. The bulb housing 12 is mounted to the screw base 16. The screw base 16 is configured to be threadably connected to a complementary light bulb socket 13, as will be described in more detail below. The LED bulb 14 includes a printed circuit board (PCB) 18. As will be described in more detail below, the assembly 10 includes an electrical connector 20 (FIGS. 2 and 3) for electrically connecting the PCB 18 to the screw base 16. The electrical connector 20 enables the PCB 18 to be electrically connected to the screw base 16, and thus the light bulb socket 13, without using any electrical wires (not shown) in the electrical path from the PCB 18 to the screw base 16.

The bulb housing 12 extends a length from a bulb end 22 to a screw base end 24 that is opposite the bulb end 22. The LED bulb 14 is mounted to the bulb end 22 of the bulb housing 12. The bulb housing 12 is mounted to the screw base 16 at the screw base end 24. A more detailed discussion of how the bulb housing 12 mounts to the screw base 16 will be described below with reference to FIG. 2. The bulb housing 12 may be fabricated from any materials, such as, but not limited to, one or more dielectric materials, one or more electrically conductive materials, and/or the like. The particular design and construction of the bulb housing 12 (including the size and shape of the bulb housing 12) may depend on the particular application of the LED bulb assembly 10. The bulb housing 12 may include one or more of the light directing components 30 and/or the support and/or protection components described below.

The LED bulb 14 includes the PCB 18. In the illustrated embodiment, one or more LEDs 26 is mounted to the PCB 18. Although only a single LED 26 is shown mounted to the PCB 18, any number of LEDs 26 may be mounted to the PCB 18. Moreover, the LED bulb 14 may include any number of other PCBs in addition to the PCB 18. Each PCB of the LED bulb 14 may or may not include any LEDs 26 mounted thereto, and the LED bulb 14 may or may not include one or more LEDs 26 that is not mounted on a PCB (e.g., the PCB 18) of the LED bulb 14. For example, the LED bulb 14 may include one or more PCBs that performs driver and/or other electronic functions of the LED bulb 14 but does not include any LEDs 26 of the LED bulb 14 mounted thereto. In the illustrated embodiment, the PCB 18 performs driver and/or other electronic functions of the LED bulb 14 and includes an LED 26 mounted thereto. Moreover, in the illustrated embodiment, the LED bulb 14 is what is commonly referred to as a "chip-on-board" (COB) LED. But, the LED bulb 14 may be any other type of LED bulb, such as, but not limited to, an LED bulb that includes one or more LEDs soldered to a PCB. The PCB 18 generally includes a rectangular shape in the illustrated embodiment. But, the PCB 18 may additionally or alternatively include any other shape. A substrate 28 of the PCB 18 may be fabricated from any materials, such as, but not limited to, a ceramic, polytetrafluoroethylene, FR-4, FR-1, CEM-1, CEM-3, FR-2, FR-3, FR-5, FR-6, G-10, CEM-2, CEM-4, CEM-5, an insulated metal substrate (IMS) and/or the like.

The LED bulb 14 may include one or more light directing components 30 for directing light emitted from the LED(s) 26, such as, but not limited to, one or more reflectors, lens, transparent covers, non-transparent covers, and/or the like. Moreover, the LED bulb 14 may include one or more support and/or protection components (not shown) for supporting and/or protecting the various components of the LED bulb 14. The particular design and construction of the LED bulb 14 (including what types of components the LED bulb 14 includes) may depend on the particular application of the LED bulb assembly 10. Examples of suitable applications of the LED bulb assembly 10 include, but are not limited to, a light engine, a light fixture, and/or other lighting system that is used for residential, commercial, and/or industrial use. The LED bulb assembly 10 may be used for general purpose lighting, or alternatively, may have a customized application and/or end use.

Although the embodiments described and/or illustrated herein are described and illustrated with respect to LED bulbs (e.g., the LED bulb 14, 214, 314, 414, 514, 614, 714, 814, 914, and 1014 described and illustrated with respect to FIGS. 1-4, 5-9, 10-12, 13-15, 16, 17-19, 20-22, 23-25, and 26-28, respectively) having one or more LEDs (e.g., the LEDs 26 and 226 shown in FIGS. 1 and 5, respectively) that emit light, the embodiments described and/or illustrated herein are not limited to LED light bulbs. Rather, the embodiments described and/or illustrated herein are applicable to any type of light bulb (having any type of light emitting device) that includes a PCB, such as, but not limited to, compact fluorescent lamp (CFL) light bulbs and/or the like. In other words, the embodiments described and/or illustrated herein may be used to electrically connect a PCB of any type of light bulb to the base that connects the light bulb to the complementary light bulb socket or directly to the complementary light bulb socket. Accordingly, the LED bulbs 14, 214, 314, 414, 514, 614, 714, 814, 914, and 1014 described and illustrated with respect to FIGS. 1-4, 5-9, 10-12, 13-15, 16, 17-19, 20-22, 23-25, and 26-28 may each be any other type of light bulb that includes a PCB, such as, but not limited to, a compact fluorescent lamp (CFL) light bulb and/or the like.

In the illustrated embodiment, the screw base 16 includes a threaded shell 32 that is configured to be threadably connected to the complementary light bulb socket 13. Specifically, the threaded shell 32 includes an exterior thread 34 that is configured to threadably connect to a complementary interior thread 15 of the light bulb socket 13. The screw base 16 may be a standard Edison screw fitting for light bulbs that is configured to be mounted to a standard and complementary sized light bulb socket 13. Specifically, the threaded shell 32 of the screw base 16 provides a portion of a standard Edison screw fitting that is configured to be threadably connected to the complementary light bulb socket 13. The threaded shell 32 of the screw base 16 is electrically conductive and defines a negative terminal of the LED bulb assembly 10. Specifically, the threaded shell 32 threadably connects to a corresponding negative terminal (not shown) of the complementary light bulb socket 13 to provide a negative electrical connection between the LED bulb assembly 10 (and more specifically the PCB 18) and the light bulb socket 13. The threaded shell 32 is optionally a stamped and formed shell that is fabricated using a stamping process, a forming process, and/or the like.

In the illustrated embodiment, the threaded shell 32 includes a socket 36 that receives the screw base end 24 of the bulb housing 12 therein. The threaded shell 32 includes a thru opening 38 that extends through an end wall 40 of the threaded shell 32 and into communication with the socket 36. The screw base 16 includes an electrical insulator 42 that is held by the threaded shell 32 within the thru opening 38. The insulator 42 includes an opening 44 that extends therethrough for receiving a positive terminal 46 of the LED bulb assembly 10. The thru opening 38 and the opening 44 are better seen in FIG. 3. The insulator 42 may be a standard insulator of a standard Edison screw base for light bulbs. Such a standard insulator may include the opening 44 as supplied or may be modified to include the opening 44 and/or to configure an existing opening as the opening 44.

The positive terminal 46 is configured to mate with a corresponding positive terminal (not shown) of the complementary light bulb socket 13 to provide a positive electrical connection between the LED bulb assembly 10 (and more specifically the PCB 18) and the light bulb socket 13. The positive terminal 46 replaces the standard positive terminal of a standard Edison screw base for light bulbs. The positive terminal 46 may be considered to be a component of the screw base 16, of the assembly 10, and/or of the electrical connector 20.

The embodiments described and/or illustrated herein are not limited to standard Edison screw fittings, nor screw fittings generally. In other words, the screw base 16 is not limited to being a screw fitting that threadably connects to the complementary light bulb socket. Rather, the embodiments described and/or illustrated herein may be used with any other type of light bulb base that connects to the complementary light bulb socket with any other type of connection, such as, but not limited to, a bayonet base that is configured to connect to a complementary light bulb socket with a bayonet style connection, and/or the like. In other words, the bases 16, 216, 416, 516, and 616 described and illustrated with respect to FIGS. 1-4, 5-9, 10-12, 13-15, and 16 may each be any other type of base that that connects to the complementary light bulb socket with any other type of connection, such as, but not limited to, a bayonet base that is configured to connect to a complementary light bulb socket with a bayonet style connection, and/or the like. It should be understood that the light bulb socket 13 and the thread 15 thereof are exemplary only. The light bulb sockets described and/or illustrated herein (e.g., the light bulb socket 13) may have any configuration, structure, and/or means that is complementary to the corresponding type of base (e.g., the bases 16, 216, 416, 516, and 616).

Figure 2:
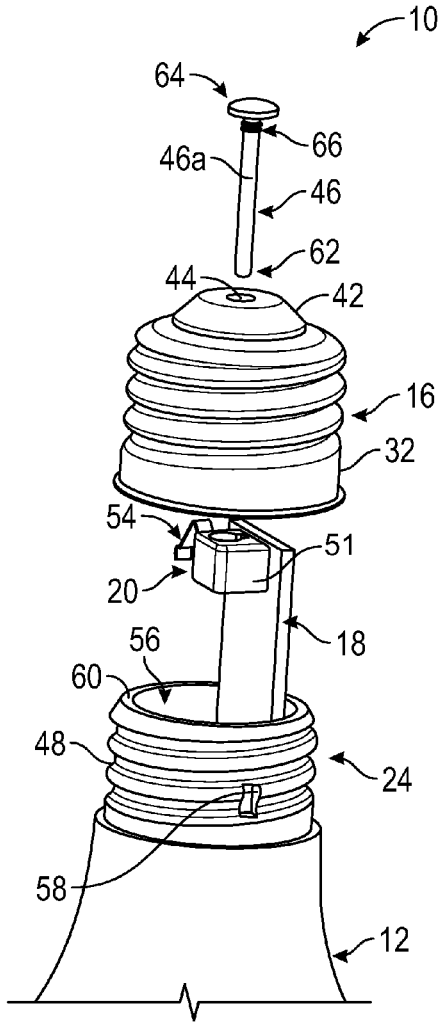
FIG. 2 is an exploded perspective view of a portion of the LED bulb assembly shown in FIG. 1.

FIG. 2 is an exploded perspective view of a portion of the LED bulb assembly 10. The bulb housing 12 may be mounted to the screw base 16 using any suitable method, means, structure, connection type, and/or the like. In the illustrated embodiment, the screw base end 24 of the bulb housing 12 includes an exterior thread 48 for threadably connecting to a complementary interior thread 50 (FIG. 3) of the threaded shell 32 to mount the bulb housing 12 to the screw base 16. An example of another type of connection for mounting the bulb housing 12 to the screw base 16 includes crimping the screw base 16 to the bulb housing 12, and/or the like. The threads 48 and 50 and the threaded connection therebetween are better illustrated in FIG. 3.

The electrical connector 20 of the LED bulb assembly 10 is mounted to the PCB 18. The electrical connector 20 includes a connector housing 51, a positive contact 52 (FIG. 3) held by the connector housing 51, and a negative contact 54 held by the connector housing 51. As will be described in more detail below, the positive contact 52 is configured to mate with the positive terminal 46 and the negative contact 54 is configured to mate with the threaded shell 32 to electrically connect the PCB 18 to the screw base 16.

Figure 3:
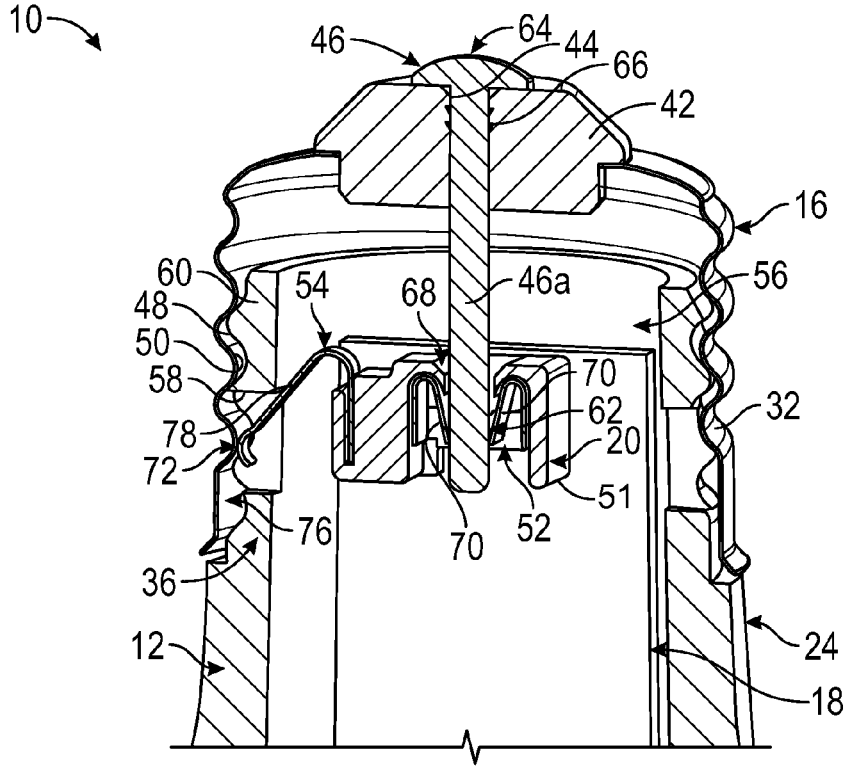
FIG. 3 is a perspective view illustrating a cross section of a portion of the LED bulb assembly shown in FIGS. 1 and 2.

The bulb housing 12 includes an interior cavity 56 within which at least a portion of the PCB 18 extends, as is shown in FIG. 3. The bulb housing 12 includes one or more thru openings 58 that extend through a wall 60 of the bulb housing 12 into communication with the interior cavity 56. The thru opening 58 enables the negative contact 54 to extend through the wall 60 into engagement in physical contact with the threaded shell 32 to thereby electrically connect the negative contact 54 to the threaded shell 32.

The electrical connector 20 is mounted to the PCB 18 such that the positive contact 52 and the negative contact 54 are each electrically connected to the PCB 18. Each contact 52 and 54 may be electrically connected to the PCB 18 using any method, means, structure, mounting type, and/or the like. For example, the contact 52 and/or the contact 54 may include one or more press-fit pins (not shown; e.g., eye-of-the needle pins and/or the like) that are configured to be mounted to the PCB 18 by being press-fit into corresponding electrical vias (not shown) or other openings (not shown) of the PCB 18. Moreover, and for example, the contact 52 and/or the contact 54 may include one or more solder posts (not shown) that are configured to be mounted to the PCB 18 by received within corresponding electrical vias (not shown) or other openings (not shown) of the PCB 18 and soldered to the PCB 18. Yet another example includes providing the contact 52 and/or the contact 54 with one or more surface mount members (not shown; e.g., a foot and/or the like) that are configured to be surface-mounted to the PCB 18.

The positive terminal 46 is held by the threaded shell 32, and more specifically by the insulator 42. In the illustrated embodiment, the positive terminal 46 of the LED bulb assembly 10 includes a pin 46*a* that extends a length from a connector mating end 62 to socket mating end 64 that is opposite the connector mating end 62. The pin 46*a* is configured to be held by the insulator 42 such that the pin 46*a* extends through the opening 44 and into the interior cavity 56 of the bulb housing 12. As will be described below with reference to FIG. 3, the pin 46*a* is configured to mate with the positive contact 52 of the electrical connector at the connector mating end 62 of the pin 46*a*. The pin 46*a* is configured to mate with the corresponding positive terminal of the complementary light bulb socket 13 at the socket mating end 64 of the pin 46*a*. Optionally, the pin 46*a* includes one or more barbs 66 and/or other protrusions for providing an interference fit with the insulator 42.

FIG. 3 is a perspective view illustrating a cross section of a portion of the LED bulb assembly 10. The screw base end 24 of the bulb housing 12 is received within the socket 36 of the threaded shell 32 such that the threads 48 and 50 are threadably connected together. The threaded connection between the screw base end 24 of the bulb housing 12 and the threaded shell 32 mounts the bulb housing 12 to the screw base 16.

The pin 46*a* of the positive terminal 46 is held by the insulator 42 of the screw base 16 such that the pin 46*a* extends through the opening 44 and into the interior cavity 56 of the bulb housing 12. The connector mating end 62 of the pin 46*a* extends into a mating socket 68 of the connector housing 51 and is mated with the positive contact 52 of the electrical connector 20. Specifically, the connector mating end 62 of the pin 46*a* is engaged in physical contact with, and thereby electrically connected to, the positive contact 52. The electrical connection between the positive contact 52 of the electrical connector 20 and the positive terminal 46 provides the positive electrical connection between the PCB 18 and the screw base 16

The positive contact 52 may have any structure that enables the positive contact 52 to mate with the pin 46*a* of the positive terminal 46. In the illustrated embodiment, the positive contact 52 includes a pair of opposing spring fingers 70 that engage the connector mating end 62 of the pin 46*a* therebetween to establish the electrical contact between the pin 46*a* and the positive contact 52. Examples of other suitable structures of the positive contact 52 for mating with the positive terminal 46 include, but are not limited to, a blade, a socket, a pin, a spring arm, and/or the like. Although two are shown, the positive contact 52 may include any number of the spring fingers 70.

As can be seen in FIG. 3, when the pin 46*a* is mated with the positive contact 52 of the electrical connector 20, the socket mating end 64 of the pin 46*a* is exposed for mating with the corresponding positive terminal of the complementary light bulb socket 13.

In the illustrated embodiment, the barbs 66 of the pin 46*a* are engaged with the insulator 42 within the opening 44 for holding the pin 46*a* to the insulator 42 using an interference fit. But, in addition or alternative to the interference fit, the pin 46*a* may be held by the insulator 42 using any other structure, means, connection type, and/or the like, such as, but not limited to, using a snap-fit, using an adhesive, and/or the like.

The negative contact 54 of the electrical connector 20 is mated with the threaded shell 32 of the screw base 16. Specifically, a mating end 72 of the negative contact 54 extends through the thru opening 58 within the wall 60 of the bulb housing 12 and into engagement in physical contact with an interior side 76 of the threaded shell 32. The engagement between the mating end 72 of the negative contact 54 and the interior side 76 of the threaded shell 32 electrically connects the negative contact 54 to the threaded shell 32. The electrical connection between the negative contact 54 of the electrical connector 20 and the threaded shell 32 provides the negative electrical connection between the PCB 18 and the screw base 16.

The negative contact 54 may have any structure that enables the negative contact 54 to mate with the threaded shell 32 of the screw base 16. In the illustrated embodiment, the negative contact 54 includes a spring arm 78 that engages the interior side 76 of the threaded shell 32 to establish the electrical contact between the negative contact 54 and the threaded shell 32. Examples of other suitable structures of the negative contact 54 for mating with the threaded shell 32 include, but are not limited to, a blade, a tab, a finger, and/or the like. Although one is shown, the negative contact 54 may include any number of the spring arms 78.

The positive and negative electrical connections provided by the positive and negative contacts 52 and 54, respectively, of the electrical connector 20 electrically connect the PCB 18 to the screw base 16 and enable the LED bulb assembly 10 to be electrically connected to the complementary light bulb socket 13. The electrical connector 20 enables the PCB 18 to be electrically connected to the screw base 16, and thus the light bulb socket 13, without using any electrical wires (not shown) in the electrical path from the PCB 18 to the screw base 16. The electrical connector 20 may eliminate solder connections between electrical wires and the screw base 16 (i.e., between the electrical wires and the threaded shell 32 and between the electrical wires and the positive terminal 46). The LED bulb assembly 10 may be less time consuming to manufacture than at least some known LED bulb assemblies. The LED bulb assembly 10 may be more easily manufactured without or with less quality defects than at least some known LED bulb assemblies.

Figure 4:
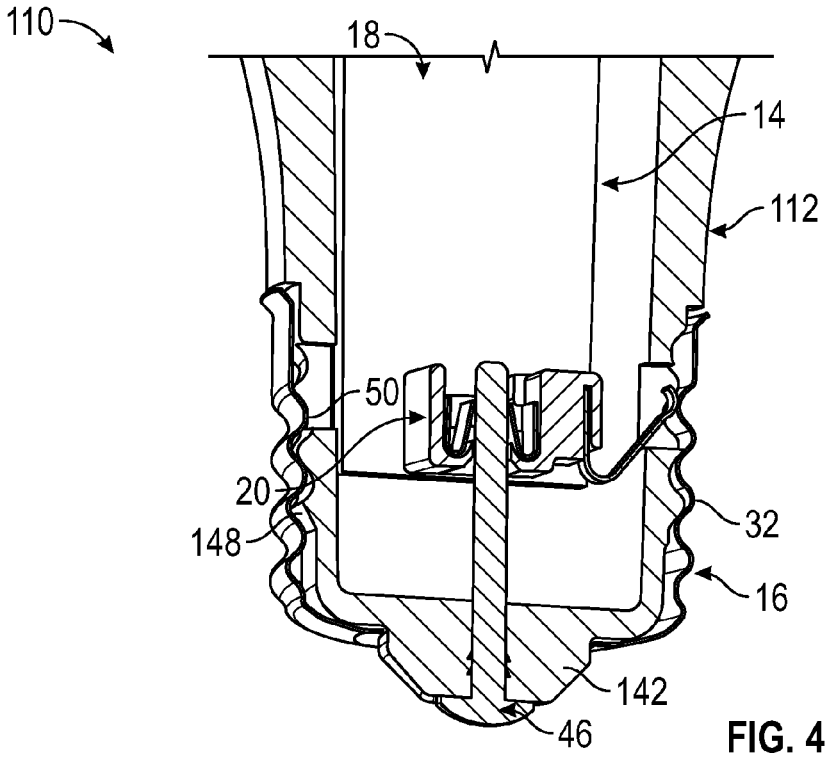
FIG. 4 is a perspective view illustrating a cross section of a portion of another embodiment of an LED bulb assembly.

FIG. 4 is a perspective view illustrating a cross section of a portion of another embodiment of an LED bulb assembly 110. The assembly 110 includes a bulb housing 112, the LED bulb 14, and the screw base 16. The bulb housing 112 is mounted to the screw base 16. The LED bulb 14 includes the PCB 18 and the assembly 110 includes the electrical connector 20 for electrically connecting the PCB 18 to the screw base 16.

In the embodiment of FIG. 4, an insulator 142 of the screw base 16 is formed as a single, unitary body with at least a portion of the bulb housing 12. As can be seen in FIG. 4, the insulator 142 holds the positive terminal 46 of the LED bulb assembly 110 and is held by the threaded shell 32 of the screw base 16. The insulator 142 comprises an exterior thread 148 that is threadably connected to the interior thread 50 of the threaded shell 32.

The insulator 142 replaces the standard insulator (e.g., the insulator 42 shown in FIGS. 1-3) of a standard base (e.g., an Edison screw fitting, a bayonet style fitting, and/or the like) for light bulbs. As used herein, two or more items define a "single, unitary body" when the items are formed as a single continuous structure. In some embodiments, two or more items are considered to be formed as a single continuous structure if the items are incapable of being separated without damaging (such as, but not limited to, cutting through, breaking, melting, and/or the like) at least one of the items and/or a fastener that joins the items together. One example of items that are formed as a single continuous structure is two items that are integrally formed (e.g., formed from the same stamp of a sheet or reel of material, molded together, cast together, and/or the like). Another example of items that are formed as a single continuous structure is two items that are mechanically joined together after formation of both of the items using a mechanical fastener (e.g., an adhesive, a weld, a solder joint, and/or the like) that joins the items together such that the items are incapable of being separated without damaging at least one of the items and/or the mechanical fastener. One example of items that are not formed as a single continuous structure is two items that are mechanically joined together after formation of both of the items using a mechanical fastener (e.g., a threaded fastener, a clip, a clamp, and/or the like) that joins the items together such that the items are capable of being separated without damaging the items and the mechanical fastener.

The LED bulb assembly 110 may be less time consuming to manufacture than at least some known LED bulb assemblies. The LED bulb assembly 110 may be more easily manufactured without or with less quality defects than at least some known LED bulb assemblies.

Figure 5:
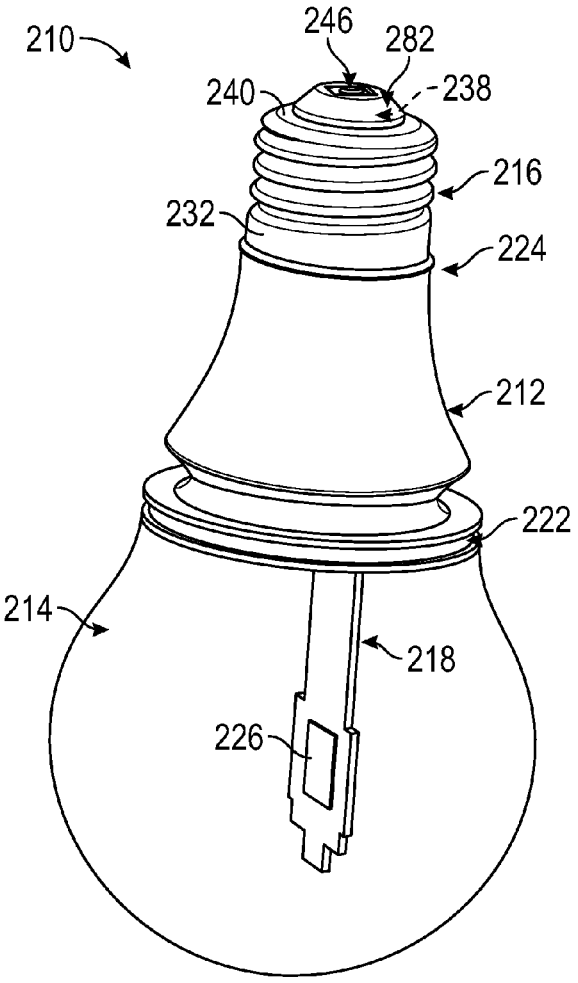
FIG. 5 is a perspective view of another embodiment of an LED bulb assembly.

FIG. 5 is a perspective view of another embodiment of an LED bulb assembly 210. The assembly 210 includes a bulb housing 212, an LED bulb 214 held by the bulb housing 212, and a screw base 216. The bulb housing 212 is mounted to the screw base 216. The screw base 216 is configured to be threadably connected to a complementary light bulb socket (e.g., the light bulb socket 13 shown in FIG. 1). The LED bulb 214 includes a PCB 218. The assembly 210 includes an electrical connector 220 (FIGS. 6-8) for electrically connecting the PCB 218 to the screw base 216. The electrical connector 220 enables the PCB 218 to be electrically connected to the screw base 216, and thus the light bulb socket, without using any electrical wires (not shown) in the electrical path from the PCB 218 to the screw base 216.

The bulb housing 212 extends a length from a bulb end 222 to a screw base end 224 that is opposite the bulb end 222. The LED bulb 214 is mounted to the bulb end 222 of the bulb housing 212. The bulb housing 212 is mounted to the screw base 216 at the screw base end 224.

The LED bulb 214 includes the PCB 218 and one or more LEDs 226, which may or may not be mounted to the PCB 218. In the illustrated embodiment, a single LED 226 is mounted to the PCB 218, however, any number of LEDs 226 may be mounted to the PCB 218 and the LED bulb 214 may include any number of LEDs 226 overall.

The screw base 216 includes a threaded shell 232 that is configured to be threadably connected to the complementary light bulb socket. In the illustrated embodiment, the threaded shell 232 of the screw base 216 provides a portion of a standard Edison screw base that is configured to be threadably connected to the complementary light bulb socket.

The threaded shell 232 of the screw base 216 is electrically conductive and defines a negative terminal of the LED bulb assembly 210. Specifically, the threaded shell 232 threadably connects to a corresponding negative terminal (not shown) of the complementary light bulb socket to provide a negative electrical connection between the LED bulb assembly 210 (and more specifically the PCB 218) and the light bulb socket.

The threaded shell 232 includes a thru opening 238 that extends through an end wall 240 of the threaded shell 232. The thru opening 238 is better seen in FIGS. 6-8. The LED bulb assembly 210 includes a mating connector 282 that is configured to mate with the electrical connector 220 to electrically connect the PCB 218 to a positive terminal 246 of the LED bulb assembly 210. As shown in FIG. 5, the mating connector 282 is held by the threaded shell 232 within the thru opening 238. The mating connector 282 includes the positive terminal 246 of the LED bulb assembly 210. The positive terminal 246 is configured to mate with a corresponding positive terminal (not shown) of the complementary light bulb socket to provide a positive electrical connection between the LED bulb assembly 210 (and more specifically the PCB 218) and the light bulb socket. The positive terminal 246 replaces the standard positive terminal of a standard Edison screw base for light bulbs.

Figure 6:
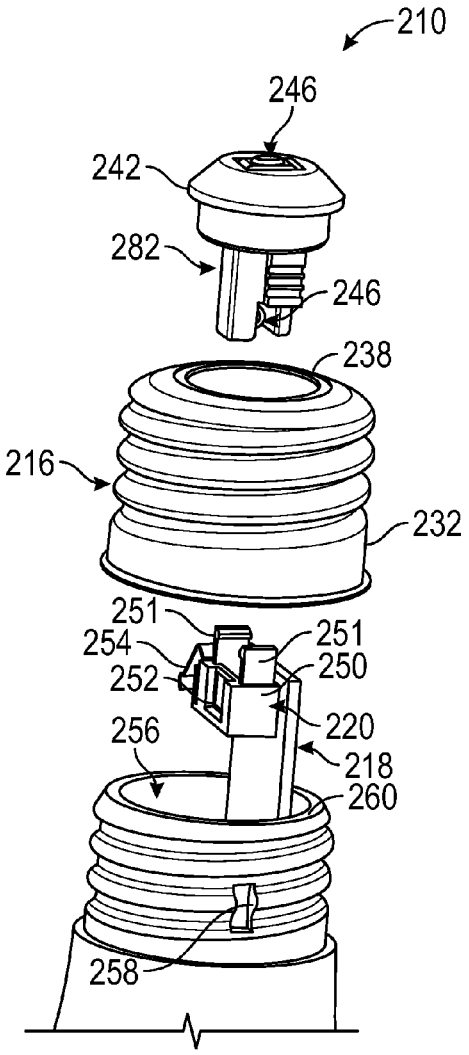
FIG. 6 is an exploded perspective view of a portion of the LED bulb assembly shown in FIG. 5.

FIG. 6 is an exploded perspective view of a portion of the LED bulb assembly 210. The electrical connector 220 of the LED bulb assembly 210 is mounted to the PCB 218. The electrical connector 220 includes a connector housing 250, a positive contact 252 held by the connector housing 250, and a negative contact 254 held by the connector housing 250. As will be described in more detail below, the positive contact 252 is configured to mate with the positive terminal 246 and the negative contact 254 is configured to mate with the threaded shell 232 to electrically connect the PCB 218 to the screw base 216. Optionally, the connector housing 250 includes one or more latches 251 and/or another structure for holding the connectors 220 and 282 as mated together. The latch(es) 251 optionally facilitate guiding and/or aligning the connectors 220 and 282 as the connectors 220 and 282 are mated together. Although two are shown, the connector housing 250 may include any number of the latches 251.

The bulb housing 212 includes an interior cavity 256 within which at least a portion of the PCB 218 extends. The bulb housing 212 includes one or more thru openings 258 that extend through a wall 260 of the bulb housing 212 into communication with the interior cavity 256. The thru opening 258 enables the negative contact 254 to extend through the wall 260 into engagement in physical contact with the threaded shell 232 to thereby electrically connect the negative contact 254 to the threaded shell 232.

The electrical connector 220 is mounted to the PCB 218 such that the positive contact 252 and the negative contact 254 are each electrically connected to the PCB 218. Each contact 252 and 254 may be electrically connected to the PCB 218 using any method, means, structure, mounting type, and/or the like. Examples of structures of the contact 252 and/or the contact 254 include, but are not limited to, one or more press-fit pins (not shown; e.g., eye-of-the needle pins and/or the like), one or more solder posts (not shown), one or more surface mount members (not shown), and/or the like.

The mating connector 282 includes an insulator 242 and the positive terminal 246. The positive terminal 246 is held by the insulator 242. The insulator 242 of the mating connector 282 is held within the thru opening 238 of the threaded shell 232 of the screw base 216. The insulator 242 of the mating connector 282 replaces the standard insulator (e.g., the insulator 42 shown in FIGS. 1-3) of a standard base (e.g., an Edison screw fitting, a bayonet style fitting, and/or the like) for light bulbs.

Figure 7:
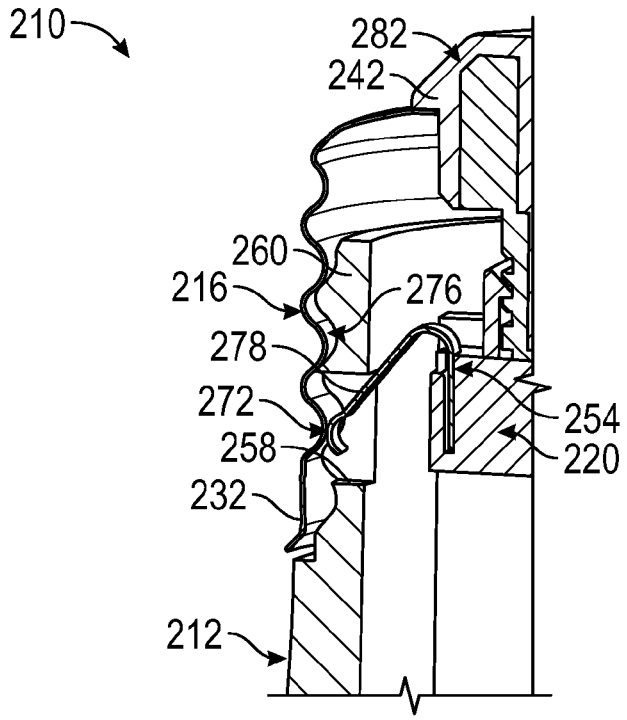
FIG. 7 is a perspective view illustrating a cross section of a portion of the LED bulb assembly shown in FIGS. 5 and 6.

FIG. 7 is a perspective view illustrating a cross section of a portion of the LED bulb assembly 210. FIG. 7 illustrates the bulb housing 212 mounted to the screw base 216. FIG. 7 also illustrates the mating connector 282 and the electrical connector 220 as mated together. The negative contact 254 of the electrical connector 220 is mated in electrical contact with the threaded shell 232 of the screw base 216. Specifically, a mating end 272 of the negative contact 254 extends through the thru opening 258 within the wall 260 of the bulb housing 212 and into engagement in physical contact with an interior side 276 of the threaded shell 232. The engagement between the mating end 272 of the negative contact 254 and the interior side 276 of the threaded shell 232 electrically connects the negative contact 254 to the threaded shell 232. The electrical connection between the negative contact 254 of the electrical connector 220 and the threaded shell 232 provides the negative electrical connection between the PCB 218 and the screw base 216.

The negative contact 254 may have any structure that enables the negative contact 254 to mate with the threaded shell 232 of the screw base 216. In the illustrated embodiment, the negative contact 254 includes a spring arm 278 that engages the interior side 276 of the threaded shell 232 to establish the electrical contact between the negative contact 254 and the threaded shell 232. Examples of other suitable structures of the negative contact 254 for mating with the threaded shell 232 include, but are not limited to, a blade, a tab, a finger, and/or the like. Although one is shown, the negative contact 254 may include any number of the spring arms 278.

Figure 8:
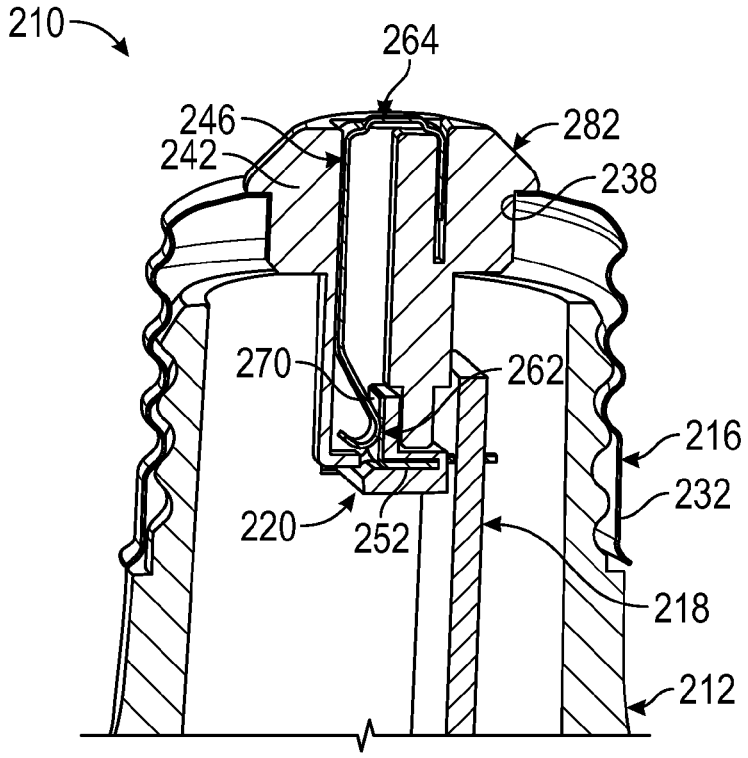
FIG. 8 is a perspective view illustrating another cross section of a portion of the LED bulb assembly shown in FIGS. 5-7.

FIG. 8 is a perspective view illustrating another cross section of a portion of the LED bulb assembly 210. FIG. 8 illustrates the bulb housing 212 mounted to the screw base 216 and also illustrates the mating connector 282 and the electrical connector 220 are mated together.

The positive terminal 246 is held by the insulator 242. The positive terminal 246 includes a connector mating end 262 and a socket mating end 264. When the insulator 242 is held within the thru opening 238 of the threaded shell 232 such that the connectors 220 and 282 are mated together as shown in FIG. 8, the connector mating end 262 of the positive terminal 246 is mated in electrical contact with the positive contact 252 of the electrical connector 220. Specifically, the connector mating end 262 of the positive terminal 246 is engaged in physical contact with, and thereby electrically connected to, the positive contact 252. The electrical connection between the positive contact 252 of the electrical connector 220 and the positive terminal 246 of the mating connector 282 provides the positive electrical connection between the PCB 218 and the screw base 216.

The positive contact 252 may have any structure that enables the positive contact 252 to mate with the connector mating end 262 of the positive terminal 246. In the illustrated embodiment, the positive contact 252 includes a blade 270 that engages the connector mating end 262 of the positive terminal 246 to establish the electrical contact between the positive terminal 246 and the positive contact 252. Examples of other suitable structures of the positive contact 252 for mating with the positive terminal 246 include, but are not limited to, a spring finger, a socket, a spring arm, a pin, a card edge, and/or the like. Although one are shown, the positive contact 252 may include any number of the blades 270.

When the insulator 242 extends within the thru opening 238 of the threaded shell 232 such that the connectors 220 and 282 are mated together as shown in FIG. 8, the socket mating end 264 of the positive terminal 246 is exposed for mating with the corresponding positive terminal of the complementary light bulb socket.

The positive and negative electrical connections provided by the positive contact 252 and the negative contact 254 (FIGS. 6 and 7) of the electrical connector 220 electrically connect the PCB 218 to the screw base 216 and enable the LED bulb assembly 210 to be electrically connected to the complementary light bulb socket. The connectors 220 and 282 enable the PCB 218 to be electrically connected to the screw base 216, and thus the light bulb socket, without using any electrical wires (not shown) in the electrical path from the PCB 218 to the screw base 216. The connectors 220 and 282 may eliminate solder connections between electrical wires and the screw base 216 (i.e., between the electrical wires and the threaded shell 232 and between the electrical wires and the positive terminal 246). The LED bulb assembly 210 may be less time consuming to manufacture than at least some known LED bulb assemblies. The LED bulb assembly 210 may be more easily manufactured without or with less quality defects than at least some known LED bulb assemblies.

Figure 9:
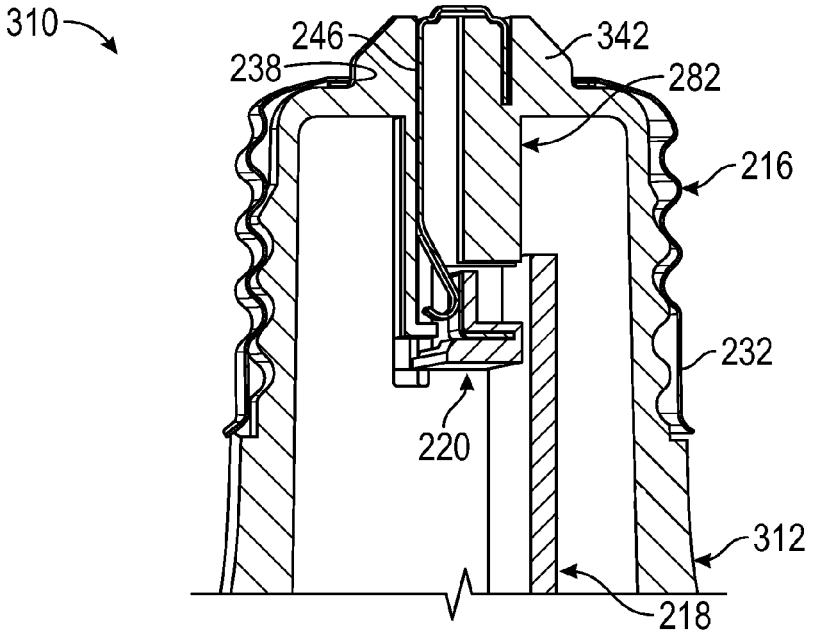
FIG. 9 is a perspective view illustrating a cross section of a portion of another embodiment of an LED bulb assembly.

FIG. 9 is a perspective view illustrating a cross section of a portion of another embodiment of an LED bulb assembly 310. The assembly 310 includes a bulb housing 312, the LED bulb 214, and the screw base 216. The bulb housing 312 is mounted to the screw base 216. The LED bulb 214 (shown in FIG. 5) includes the PCB 218 and the assembly 310 includes the connectors 220 and 282 for electrically connecting the PCB 218 to the screw base 216.

In the embodiment of FIG. 9, an insulator 342 of the mating connector 282 is formed as a single, unitary body with at least a portion of the bulb housing 312. As can be seen in FIG. 9, the insulator 342 holds the positive terminal 246 of the LED bulb assembly 310 and extends within the thru opening 238 of the threaded shell 232 of the screw base 216. The insulator 342 replaces the insulator 242 (FIGS. 6-8) and replaces the standard insulator (e.g., the insulator 42 shown in FIGS. 1-3) of a standard base (e.g., an Edison screw fitting, a bayonet style fitting, and/or the like) for light bulbs.

The LED bulb assembly 310 may be less time consuming to manufacture than at least some known LED bulb assemblies. The LED bulb assembly 310 may be more easily manufactured without or with less quality defects than at least some known LED bulb assemblies.

Figure 10:
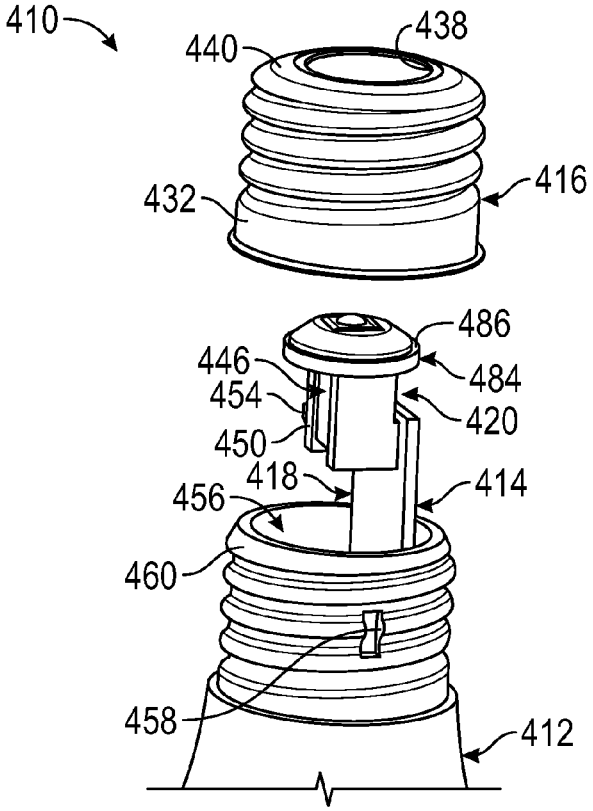
FIG. 10 is an exploded perspective view of a portion of another embodiment of an LED bulb assembly.

FIG. 10 is an exploded perspective view of another embodiment of an LED bulb assembly 410. The assembly 410 includes a bulb housing 412, an LED bulb 414 held by the bulb housing 412, and a screw base 416. The bulb housing 412 is mounted to the screw base 416. The screw base 416 is configured to be threadably connected to a complementary light bulb socket (e.g., the light bulb 13 socket shown in FIG. 1). The LED bulb 414 includes a PCB 418. The assembly 410 includes an electrical connector 420 for electrically connecting the PCB 418 to the complementary light bulb socket. The electrical connector 420 enables the PCB 418 to be electrically connected to the light bulb socket without using any electrical wires (not shown) in the electrical path from the PCB 418 to the light bulb socket.

In the illustrated embodiment, the screw base 416 includes a threaded shell 432 that is configured to be threadably connected to the complementary light bulb socket. In the illustrated embodiment, the threaded shell 432 of the screw base 416 provides a portion of a standard Edison screw base that is configured to be threadably connected to the complementary light bulb socket.

The threaded shell 432 of the screw base 416 is electrically conductive and defines a negative terminal of the LED bulb assembly 410. Specifically, the threaded shell 432 threadably connects to a corresponding negative terminal (not shown) of the complementary light bulb socket to provide a negative electrical connection between the LED bulb assembly 410 (and more specifically the PCB 418) and the light bulb socket. The threaded shell 432 includes a thru opening 438 that extends through an end wall 440 of the threaded shell 432.

The electrical connector 420 of the LED bulb assembly 410 is mounted to the PCB 418. The electrical connector 420 includes a connector housing 450, a negative contact 454 held by the connector housing 450, and a positive terminal 446 of the LED bulb assembly 410. The negative contact 454 is better seen in FIG. 11. As can be seen in FIG. 10, the positive terminal 446 is held by the connector housing 450. The positive terminal 446 is configured to mate with a corresponding positive terminal (not shown) of the complementary light bulb socket to provide a positive electrical connection between the LED bulb assembly 410 (and more specifically the PCB 418) and the light bulb socket. The positive terminal 446 replaces the standard positive terminal of a standard base (e.g., an Edison screw fitting, a bayonet style fitting, and/or the like) for light bulbs. As will be described in more detail below, the negative contact 454 is configured to mate with the threaded shell 432 of the screw base 416.

The connector housing 450 of the electrical connector 420 includes an electrically insulative plug 484 that includes an end face 486. As will be described below, the plug 484 is configured to be held by the threaded shell 432 such that the plug 484 extends within the thru opening 438 of the threaded shell 432. The plug 484 of the connector housing 450 replaces the standard insulator of a standard base (e.g., an Edison screw fitting, a bayonet style fitting, and/or the like) for light bulbs.

The bulb housing 412 includes an interior cavity 456 within which at least a portion of the PCB 418 extends. The bulb housing 412 includes one or more thru openings 458 that extend through a wall 460 of the bulb housing 412 into communication with the interior cavity 456.

The electrical connector 420 is mounted to the PCB 418 such that the positive terminal 446 and the negative contact 454 are each electrically connected to the PCB 418. Each of the positive terminal 446 and the negative contact 454 may be electrically connected to the PCB 418 using any method, means, structure, mounting type, and/or the like. Examples of structures of the positive terminal 446 and/or the negative contact 454 include, but are not limited to, one or more press-fit pins (not shown; e.g., eye-of-the needle pins and/or the like), one or more solder posts (not shown), one or more surface mount members (not shown), and/or the like.

Figure 11:
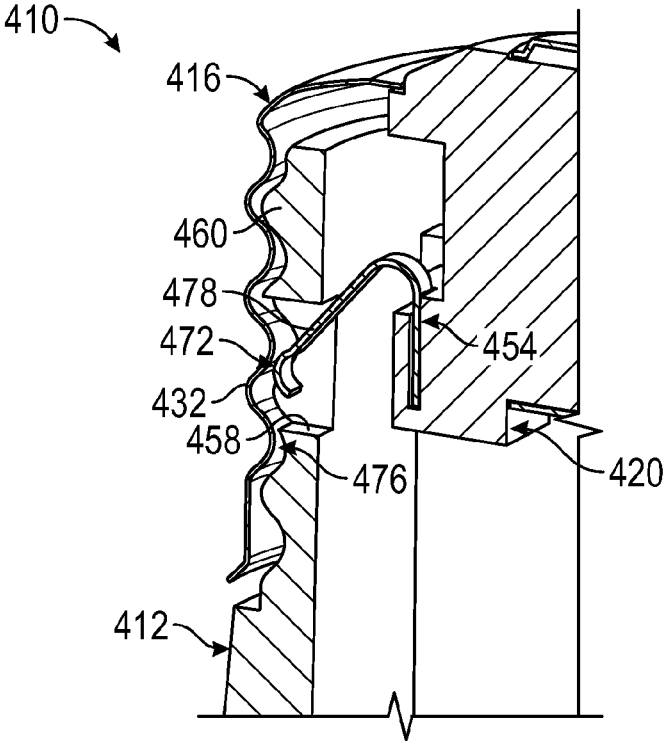
FIG. 11 is a perspective view illustrating a cross section of a portion of the LED bulb assembly shown in FIG. 10.

FIG. 11 is a perspective view illustrating a cross section of a portion of the LED bulb assembly 410. The negative contact 454 of the electrical connector 420 is mated in electrical contact with the threaded shell 432 of the screw base 416. Specifically, a mating end 472 of the negative contact 454 extends through the thru opening 458 within the wall 460 of the bulb housing 412 and into engagement in physical contact with an interior side 476 of the threaded shell 432. The engagement between the mating end 472 of the negative contact 454 and the interior side 476 of the threaded shell 432 electrically connects the negative contact 454 to the threaded shell 432.

The negative contact 454 may have any structure that enables the negative contact 454 to mate with the threaded shell 432 of the screw base 416. In the illustrated embodiment, the negative contact 454 includes a spring arm 478 that engages the interior side 476 of the threaded shell 432 to establish the electrical contact between the negative contact 454 and the threaded shell 432. Examples of other suitable structures of the negative contact 454 for mating with the threaded shell 432 include, but are not limited to, a blade, a tab, a finger, and/or the like. Although one is shown, the negative contact 454 may include any number of the spring arms 478.

Figure 12:
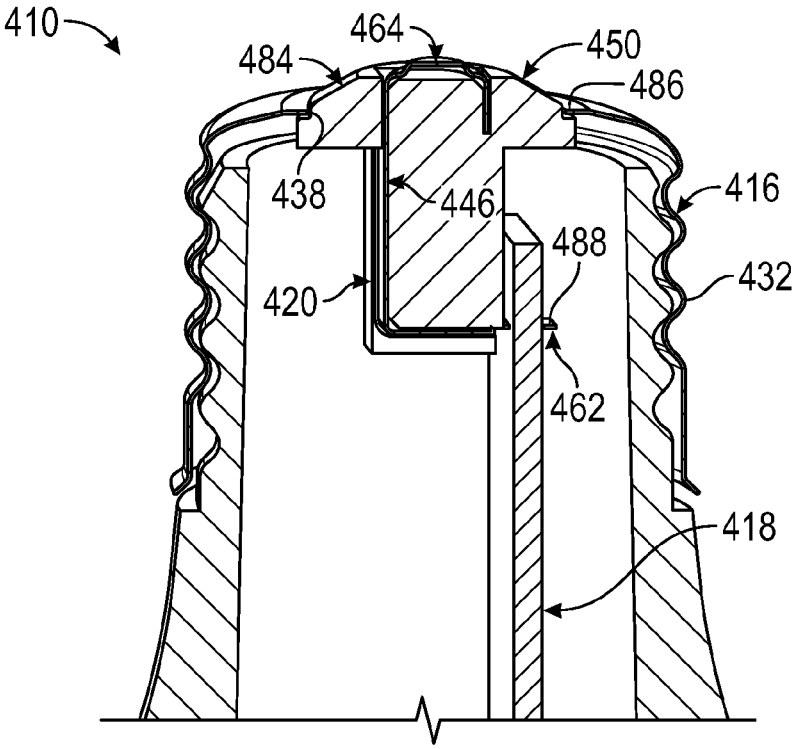
FIG. 12 is a perspective view illustrating another cross section of a portion of the LED bulb assembly shown in FIGS. 10 and 11.

FIG. 12 is a perspective view illustrating another cross section of a portion of the LED bulb assembly 410. The plug 484 of the connector housing 450 extends within the thru opening 438 of the threaded shell 432. The end face 486 of the plug 484 is optionally configured to seal the thru opening 438. The plug 484 of the connector housing 450 may define an insulator of the screw base 416.

The positive terminal 446 includes a mounting end 462 and a mating end 464. The mounting end 464 is mounted to the PCB 418. As described above, the mounting end 464 of the positive terminal 446 may have any structure for being electrically connected to the PCB 418. In the illustrated embodiment, the mounting end 464 includes a solder post 488.

The positive terminal 446 is configured to mate with the corresponding positive terminal of the complementary light bulb socket at the mating end 464. Specifically, the mating end 464 of the positive terminal 446 is held by the plug 484 such that the mating end 464 is exposed along the screw base 416 for mating with the corresponding positive terminal of the complementary light bulb socket.

The positive and negative electrical connections provided by the positive terminal 446 and the negative contact 454 (FIGS. 10 and 11) of the electrical connector 420 enable the LED bulb assembly 410 to be electrically connected to the complementary light bulb socket. The connector 420 enables the PCB 418 to be electrically connected to the light bulb socket without using any electrical wires (not shown) in the electrical path from the PCB 418 to the light bulb socket. The connector 420 may eliminate solder connections between electrical wires and the screw base 416 (i.e., between the electrical wires and the threaded shell 432 and between the electrical wires and the positive terminal 446). The LED bulb assembly 410 may be less time consuming to manufacture than at least some known LED bulb assemblies. The LED bulb assembly 410 may be more easily manufactured without or with less quality defects than at least some known LED bulb assemblies.

Figure 13:
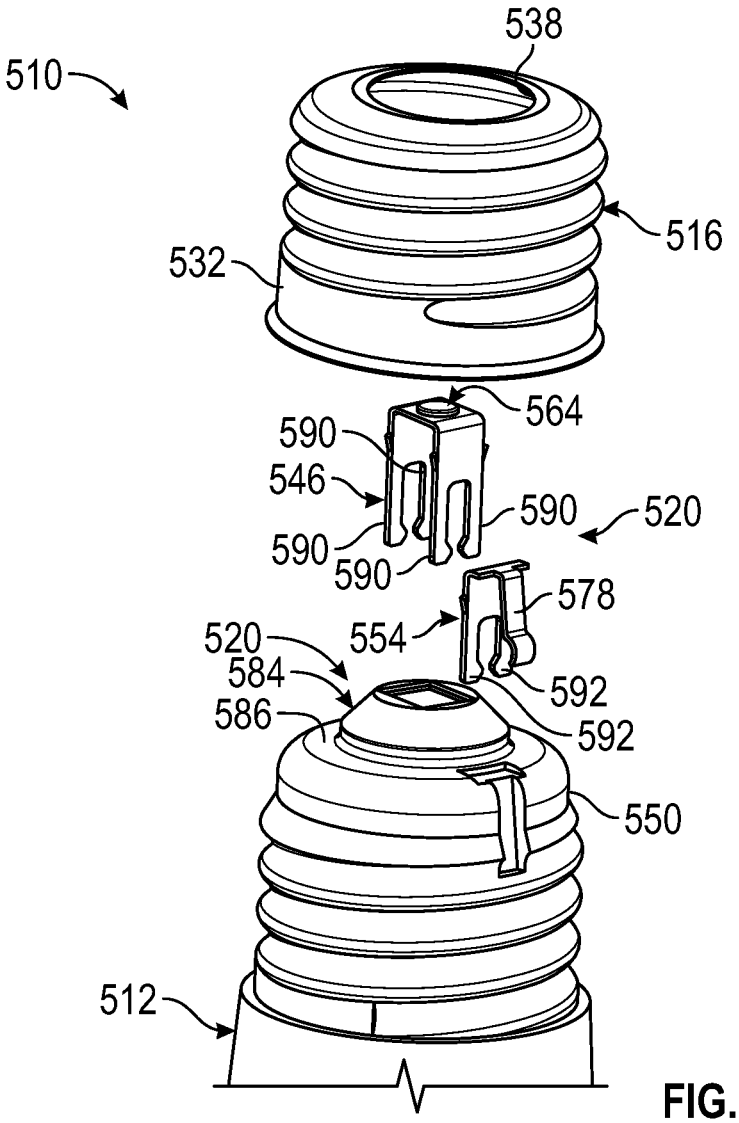
FIG. 13 is an exploded perspective view of a portion of another embodiment of an LED bulb assembly.
Figure 14:
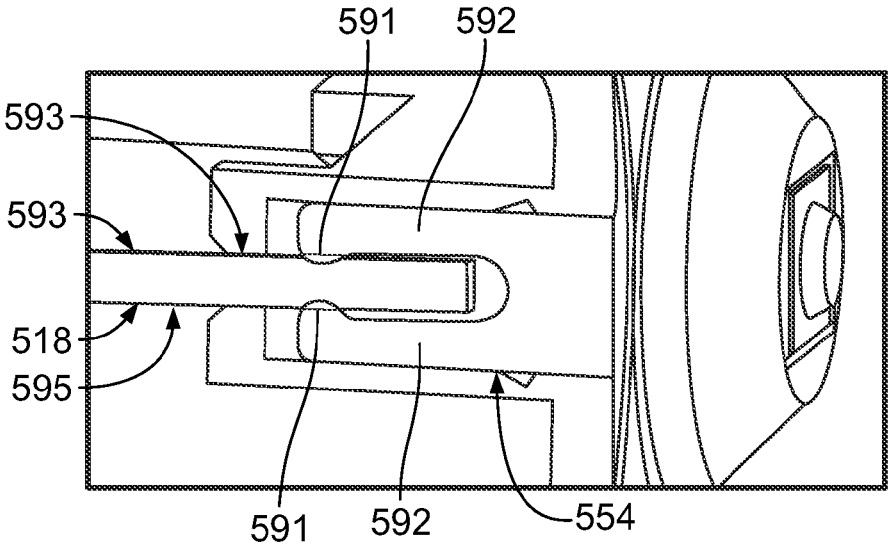
FIG. 14 is a perspective view illustrating a cross section of a portion of the LED bulb assembly shown in FIG. 13.

FIG. 13 is an exploded perspective view of a portion of another embodiment of an LED bulb assembly 510. The assembly 510 includes a bulb housing 512, an LED bulb (not shown), and a screw base 516. The bulb housing 512 is mounted to the screw base 516. The LED bulb includes a PCB 518 (FIGS. 14 and 15) and the assembly 510 includes an electrical connector 520.

In the illustrated embodiment, the screw base 516 includes a threaded shell 532 that is configured to be threadably connected to a complementary light bulb socket (e.g., the light bulb socket 13 shown in FIG. 1). In the illustrated embodiment, the threaded shell 532 of the screw base 516 provides a portion of a standard Edison screw base that is configured to be threadably connected to the complementary light bulb socket.

The electrical connector 520 includes a connector housing 550, a negative contact 554 held by the connector housing 550, and a positive terminal 546 of the LED bulb assembly 510. The negative contact 554 is configured to mate with the threaded shell 532 of the screw base 516. The positive terminal 546 is held by the connector housing 550. The positive terminal 546 is configured to mate with a corresponding positive terminal (not shown) of the complementary light bulb socket to provide a positive electrical connection between the LED bulb assembly 510 (and more specifically the PCB 518) and the light bulb socket. The positive terminal 546 replaces the standard positive terminal of a standard base (e.g., an Edison screw fitting, a bayonet style fitting, and/or the like) for light bulbs.

The connector housing 550 includes an electrically insulative plug 584 that is held by the threaded shell 532 within a thru opening 538 of the threaded shell 532. An end face 586 of the plug 584 is optionally configured to seal the thru opening 538. The plug 584 of the connector housing 550 replaces the standard insulator of a standard base (e.g., an Edison screw fitting, a bayonet style fitting, and/or the like) for light bulbs. The plug 584 may define an insulator of the screw base 516.

In the embodiment of FIG. 13, the plug 584 and the reminder of the connector housing 550 are formed as a single, unitary body with at least a portion of the bulb housing 512. As should be apparent from FIG. 13, the plug 584 holds the positive terminal 546 of the LED bulb assembly 510 such that a mating end 564 of the positive terminal 546 is exposed along the screw base 516 for mating with the corresponding positive terminal of the complementary light bulb socket.

The negative contact 554 may have any structure that enables the negative contact 554 to mate with the threaded shell 532 of the screw base 516. In the illustrated embodiment, the negative contact 554 includes a spring arm 578 that engages an interior side 576 of the threaded shell 532 to establish the electrical contact between the negative contact 554 and the threaded shell 532. Examples of other suitable structures of the negative contact 554 for mating with the threaded shell 532 include, but are not limited to, a blade, a tab, a finger, and/or the like. Although one is shown, the negative contact 554 may include any number of the spring arms 578.

Figure 15:
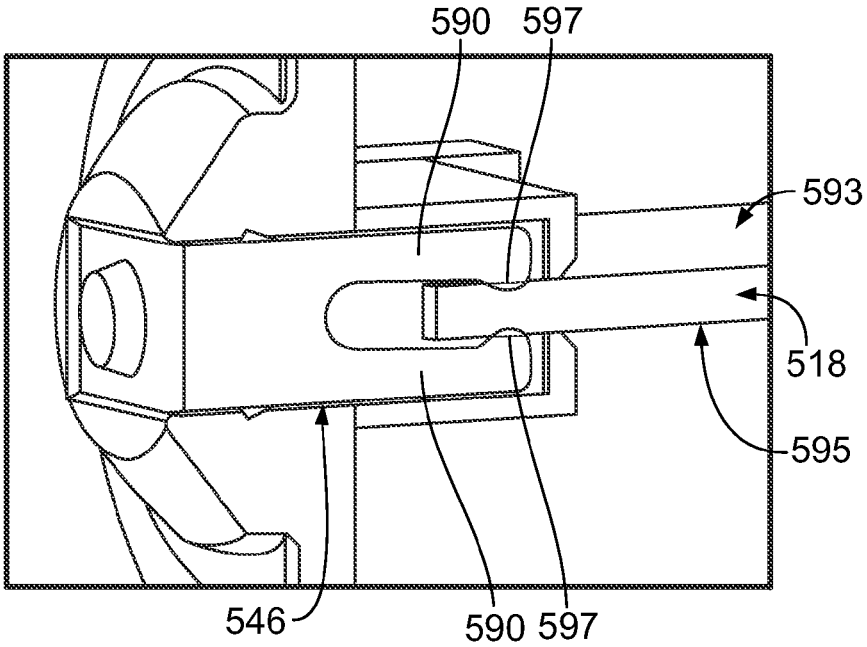
FIG. 15 is a perspective view illustrating another cross section of a portion of the LED bulb assembly shown in FIGS. 13 and 14.

Each of the positive terminal 546 and the negative contact 554 may be electrically connected to the PCB 518 using any method, means, structure, mounting type, and/or the like. In the illustrated embodiment, the positive terminal 546 and the negative terminal 554 each include one or more pairs of opposing spring arms 590 and 592, respectively, that engage the PCB 518 therebetween to electrically connect the positive terminal 546 and the negative terminal 554 to the PCB 518. For example, and referring now to FIG. 14, the opposing spring arms 592 of the negative terminal 554 engage corresponding contact pads 591 on opposite sides 593 and 595 of the PCB 518 to electrically connect the negative terminal 554 to the PCB 518. As shown in FIG. 15, the opposing spring arms 590 of the positive terminal 546 engage corresponding contact pads 597 on the opposite sides 593 and 595 of the PCB 518 to electrically connect the positive terminal 546 to the PCB 518. Referring again to FIG. 13, the negative terminal 554 may include any number of pairs of the spring arms 592 and any number of spring arms 592 overall. The positive terminal 546 may include any number of pairs of the spring arms 590 and any number of spring arms 590 overall.

The LED bulb assembly 510 may be less time consuming to manufacture than at least some known LED bulb assemblies. The LED bulb assembly 510 may be more easily manufactured without or with less quality defects than at least some known LED bulb assemblies.

Figure 16:
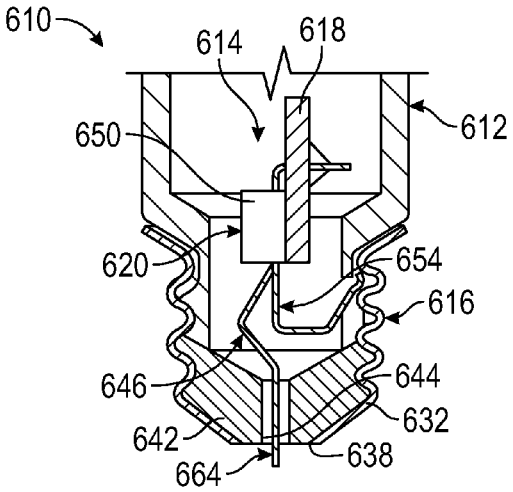
FIG. 16 is a cross sectional view a portion of another embodiment of an LED bulb assembly.

FIG. 16 is a cross sectional view a portion of another embodiment of an LED bulb assembly 610. The assembly 610 includes a bulb housing 612, an LED bulb 614, a screw base 616, and an electrical connector 620. The bulb housing 612 is mounted to the screw base 616. The LED bulb 614 includes a PCB 618.

The screw base 616 includes a threaded shell 632 that is configured to be threadably connected to a complementary light bulb socket (e.g., the light bulb socket 13 shown in FIG. 1). In the illustrated embodiment, the threaded shell 632 of the screw base 616 provides a portion of a standard Edison screw base that is configured to be threadably connected to the complementary light bulb socket (e.g., the light bulb socket 13 shown in FIG. 1). The screw base 616 includes an electrical insulator 642 that is held by the threaded shell 632 within a thru opening 638 of the threaded shell 632. The insulator 642 includes an opening 644 that extends therethrough for receiving a positive terminal 646 of the LED bulb assembly 610. The insulator 642 may be a standard insulator of a standard base (e.g., an Edison screw fitting, a bayonet style fitting, and/or the like) for light bulbs. Such a standard insulator may include the opening 644 as supplied or may be modified to include the opening 644 and/or to configure an existing opening as the opening 644.

The electrical connector 620 includes a connector housing 650, a negative contact 654 held by the connector housing 650, and the positive terminal 646, which is held by the connector housing 650. The negative contact 654 is configured to mate with the threaded shell 632 of the screw base 616. The positive terminal 646 is configured to mate with a corresponding positive terminal (not shown) of the complementary light bulb socket to provide a positive electrical connection between the LED bulb assembly 610 (and more specifically the PCB 618) and the light bulb socket. The positive terminal 646 replaces the standard positive terminal of a standard base (e.g., an Edison screw fitting, a bayonet style fitting, and/or the like) for light bulbs.

The positive terminal 646 includes a mating end 664 at which the positive terminal 646 mates with the corresponding positive terminal of the complementary light bulb socket. Specifically, the positive terminal 646 extends outward from the connector housing 650 through the opening 644 of the insulator 642 such that the mating end 664 of the positive terminal 646 is exposed through the insulator 642 for mating with the corresponding terminal of the light bulb socket. The mating end 664 of the positive terminal 646 may be resiliently deflectable to facilitate mating with the corresponding terminal of the light bulb socket.

The positive and negative electrical connections provided by the positive terminal 646 and the negative contact 654 of the electrical connector 620 enable the LED bulb assembly 610 to be electrically connected to the complementary light bulb socket. The connector 620 enables the PCB 618 to be electrically connected to the light bulb socket without using any electrical wires (not shown) in the electrical path from the PCB 618 to the light bulb socket. The connector 620 may eliminate solder connections between electrical wires and the screw base 616 (i.e., between the electrical wires and the threaded shell 632 and between the electrical wires and the positive terminal 646). The LED bulb assembly 610 may be less time consuming to manufacture than at least some known LED bulb assemblies. The LED bulb assembly 610 may be more easily manufactured without or with less quality defects than at least some known LED bulb assemblies.

Figure 17:
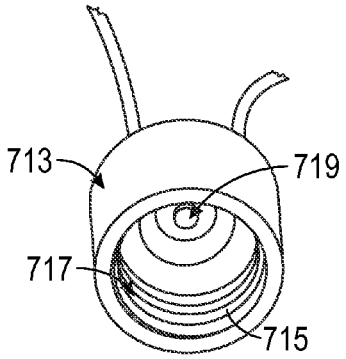
FIG. 17 is a perspective view of another embodiment of a light emitting diode (LED) bulb assembly.
Figure 17:
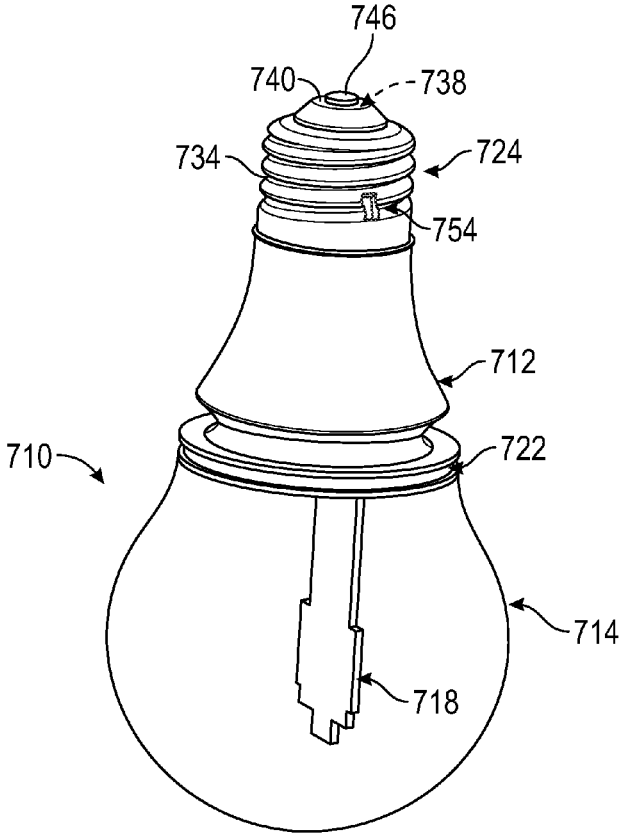

FIG. 17 is a perspective view of an embodiment of a light bulb assembly 710. In the illustrated embodiment, the light bulb assembly 710 is an LED light bulb assembly 710 that includes a bulb housing 712 and an LED bulb 714 held by the bulb housing 712. The bulb housing 712 is configured to be connected to a complementary light bulb socket 713. The LED bulb 714 includes a PCB 718. As will be described in more detail below, the assembly 710 includes an electrical connector 720 (FIG. 18) for electrically connecting the PCB 718 to the light bulb socket 713. The electrical connector 720 enables the PCB 718 to be electrically connected to the light bulb socket 713 without using any electrical wires (not shown) in the electrical path from the PCB 718 to the light bulb socket 713.

The bulb housing 712 extends a length from a bulb end 722 to a socket end 724 that is opposite the bulb end 722. The LED bulb 714 is mounted to the bulb end 722 of the bulb housing 712. The bulb housing 712 is configured to be connected to the light bulb socket 713 at the socket end 724.

In the illustrated embodiment, the bulb housing 712 includes an exterior thread 734 at the socket end 724 that is configured to be threadably connected to the complementary light bulb socket 713. Specifically, the exterior thread 734 of the bulb housing 712 is configured to threadably connect to a complementary interior thread 715 of the light bulb socket 713. The socket end 724 of the bulb housing 712 may replace a standard Edison screw fitting and/or other standard fitting (i.e., base) for light bulbs that is configured to be mounted to a standard and complementary sized light bulb socket (e.g., the light bulb socket 713). As will be described below, a negative contact 754 of the electrical connector 720 defines a negative terminal of the LED bulb assembly 710. Specifically, the negative contact 754 is configured to mate with a corresponding negative terminal 717 of the light bulb socket 713 to provide a negative electrical connection between the LED bulb assembly 710 (and more specifically the PCB 718) and the light bulb socket 713.

The socket end 724 of the bulb housing 712 includes a thru opening 738 that extends through an end wall 740 of the bulb housing 712 for receiving a positive terminal 746 of the LED bulb assembly 710. The thru opening 738 is better seen in FIG. 18.

The positive terminal 746 is configured to mate with a corresponding positive terminal 719 of the complementary light bulb socket 713 to provide a positive electrical connection between the LED bulb assembly 710 (and more specifically the PCB 718) and the light bulb socket 713. The positive terminal 746 replaces the standard positive terminal of a standard Edison screw base for light bulbs. The positive terminal 746 may be considered to be a component of the assembly 710 and/or of the electrical connector 720.

The socket end 724 of the bulb housing 712 is not limited to being a screw fitting that threadably connects to the complementary light bulb socket 713. Rather, the socket end 724 of the bulb housing 712 may have any other structure for replacing any other type of light bulb base that connects to the complementary light bulb socket with any other type of connection, such as, but not limited to, a bayonet base that is configured to connect to a complementary light bulb socket with a bayonet style connection, and/or the like.

Figure 18:
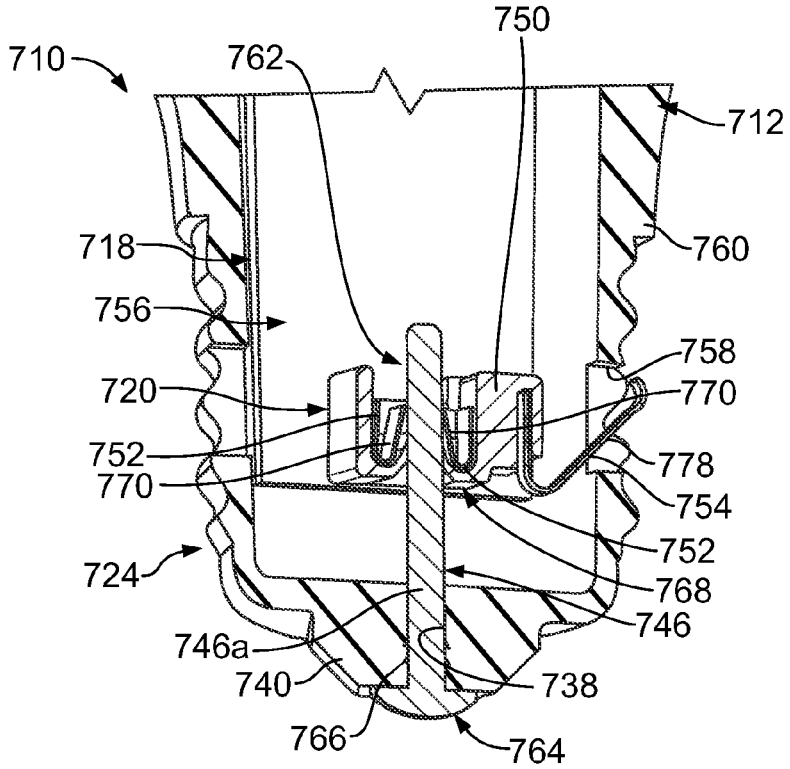
FIG. 18 is a perspective view illustrating a cross section of a portion of the LED bulb assembly shown in FIG. 17.

FIG. 18 is an exploded perspective view of a portion of the LED bulb assembly 710. The electrical connector 720 of the LED bulb assembly 710 is mounted to the PCB 718. The electrical connector 720 includes a connector housing 750, a positive contact 752 held by the connector housing 750, and the negative contact 754, which is held by the connector housing 750. The positive contact 752 is configured to mate with the positive terminal 746.

Figure 19:
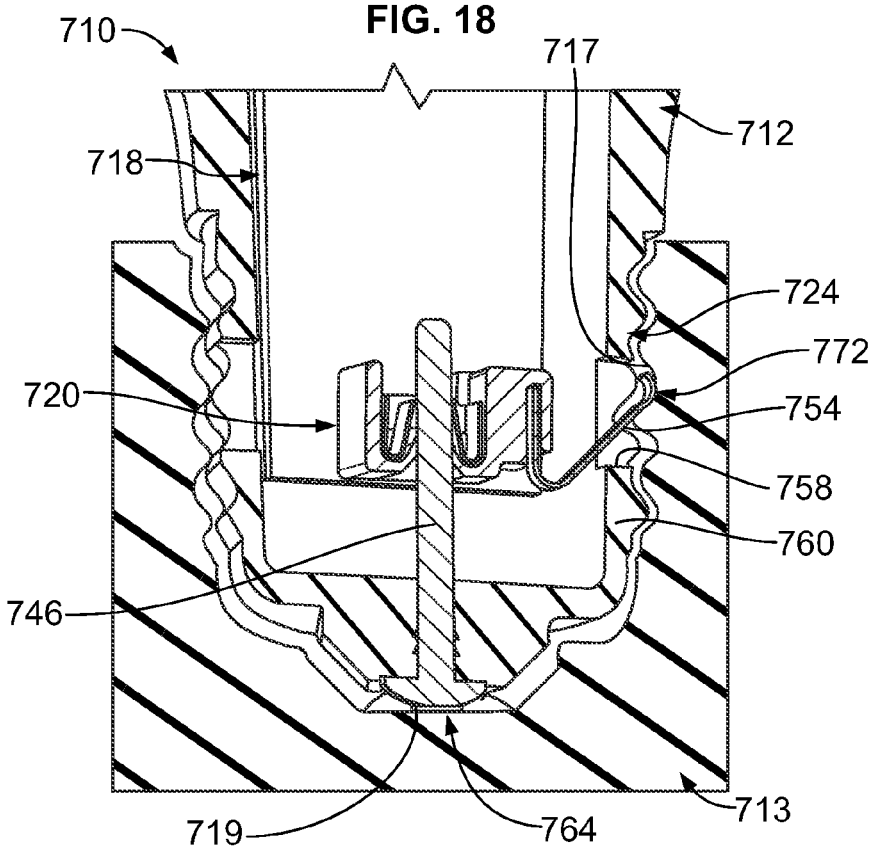
FIG. 19 is a perspective view illustrating another cross section of a portion of the LED bulb assembly shown in FIGS. 17 and 18 that illustrates the assembly as connected to an exemplary complementary light bulb socket.

The bulb housing 712 includes an interior cavity 756 within which at least a portion of the PCB 718 extends. The bulb housing 712 includes one or more thru openings 758 that extend through a wall 760 of the bulb housing 712 into communication with the interior cavity 756. The thru opening 758 enables the negative contact 754 to extend through the wall 760 into engagement in physical contact with the corresponding negative terminal 717 (FIGS. 17 and 19) of the light bulb socket 713 (FIGS. 17 and 19).

The electrical connector 720 is mounted to the PCB 718 such that the positive contact 752 and the negative contact 754 are each electrically connected to the PCB 718. Each contact 752 and 754 may be electrically connected to the PCB 718 using any method, means, structure, mounting type, and/or the like. Examples of structures of the contact 752 and/or the contact 754 include, but are not limited to, one or more press-fit pins (not shown; e.g., eye-of-the needle pins and/or the like), one or more solder posts (not shown), one or more surface mount members (not shown), and/or the like.

The positive terminal 746 is held by the socket end 724 of the bulb housing 712. In the illustrated embodiment, the positive terminal 746 of the LED bulb assembly 710 includes a pin 746*a* that extends a length from a connector mating end 762 to a socket mating end 764 that is opposite the connector mating end 762. The pin 746*a* is configured to be held by the bulb housing 712 such that the pin 746*a* extends through the thru opening 738 and into the interior cavity 756 of the bulb housing 712. The pin 746*a* is configured to mate with the positive contact 752 of the electrical connector 720 at the connector mating end 762 of the pin 746*a*. The pin 746*a* is configured to mate with the corresponding positive terminal 719 (FIGS. 17 and 19) of the complementary light bulb socket 713 at the socket mating end 764 of the pin 746*a*. Optionally, the pin 746*a* includes one or more barbs 766 and/or other protrusions for providing an interference fit with the bulb housing 712.

As shown in FIG. 18, the pin 746*a* of the positive terminal 746 is held by the bulb housing 712 such that the pin 746*a* extends through the thru opening 738 and into the interior cavity 756 of the bulb housing 712. The connector mating end 762 of the pin 746*a* extends into a mating socket 768 of the connector housing 750 and is mated with the positive contact 752 of the electrical connector 720. Specifically, the connector mating end 762 of the pin 746*a* is engaged in physical contact with, and thereby electrically connected to, the positive contact 752. The electrical connection between the positive contact 752 of the electrical connector 720 and the positive terminal 746 provides the positive electrical connection between the PCB 718 and the positive terminal 746.

The positive contact 752 may have any structure that enables the positive contact 752 to mate with the pin 746*a* of the positive terminal 746. In the illustrated embodiment, the positive contact 752 includes a pair of opposing spring fingers 770 that engage the connector mating end 762 of the pin 746*a* therebetween to establish the electrical contact between the pin 746*a* and the positive contact 752. Examples of other suitable structures of the positive contact 752 for mating with the positive terminal 746 include, but are not limited to, a blade, a socket, a pin, a spring arm, and/or the like. Although two are shown, the positive contact 752 may include any number of the spring fingers 770.

As can be seen in FIG. 18, when the pin 746*a* is mated with the positive contact 752 of the electrical connector 720, the socket mating end 764 of the pin 746*a* is exposed for mating with the corresponding positive terminal 719 of the complementary light bulb socket 713.

As briefly described above, the negative contact 754 of the electrical connector 720 defines a negative terminal of the LED bulb assembly 710 that is configured to mate with the corresponding negative terminal 717 of the light bulb socket 713. The negative contact 754 may have any structure that enables the negative contact 754 to mate with the corresponding negative terminal 717 of the light bulb socket 713. In the illustrated embodiment, the negative contact 754 includes a spring arm 778. Examples of other suitable structures of the negative contact 754 for mating with the corresponding negative terminal 717 include, but are not limited to, a blade, a tab, a finger, and/or the like. Although one is shown, the negative contact 754 may include any number of the spring arms 778.

FIG. 19 is a perspective view illustrating another cross section of a portion of the LED bulb assembly 710 that illustrates the assembly 710 as connected to the complementary light bulb socket 713. The socket end 724 of the bulb housing 712 is connected to the light bulb socket 713. The negative contact 754 of the electrical connector 720 is mated with the corresponding negative terminal 717 of the complementary light bulb socket 713. Specifically, a mating end 772 of the negative contact 754 extends through the thru opening 758 within the wall 760 of the bulb housing 712 and into engagement in physical contact with the corresponding negative terminal 717 of the light bulb socket 713. The engagement between the mating end 772 of the negative contact 754 and the corresponding negative terminal 717 of the light bulb socket 713 electrically connects the negative contact 754 to the corresponding negative terminal 717 of the light bulb socket 713. The negative contact 754 defines a negative terminal of the LED bulb assembly 710. Specifically, the electrical connection between the negative contact 754 of the electrical connector 720 and the corresponding negative terminal 717 of the light bulb socket 713 provides the negative electrical connection between the LED bulb assembly 710, and more specifically the PCB 718, and the light bulb socket 713.

As shown in FIG. 19, the positive terminal 746 is mated with the corresponding positive terminal 719 of the complementary light bulb socket 713 to provide a positive electrical connection between the LED bulb assembly 710 (and more specifically the PCB 718) and the light bulb socket 713. Specifically, the socket mating end 764 of the positive terminal 746 is mated with the corresponding positive terminal 719 of the complementary light bulb socket 713.

The positive and negative electrical connections provided by the positive and negative contacts 752 and 754, respectively, of the electrical connector 720 enable the LED bulb assembly 710 to be electrically connected to the complementary light bulb socket 713. The electrical connector 720 enables the PCB 718 to be electrically connected to the light bulb socket 713 without using any electrical wires (not shown) in the electrical path from the PCB 718 to the light bulb socket 713. The bulb housing 712 may replace a standard Edison screw fitting and/or other standard fitting (i.e., base) for light bulbs. The LED bulb assembly 710 may eliminate solder connections between electrical wires and a standard fitting (e.g., between the electrical wires and a shell [e.g., the threaded shell 32 shown in FIGS. 1-3] of a standard fitting and/or between the electrical wires and the positive terminal 746). The LED bulb assembly 710 may be less time consuming to manufacture than at least some known LED bulb assemblies. The LED bulb assembly 710 may be more easily manufactured without or with less quality defects than at least some known LED bulb assemblies.

Figure 20:
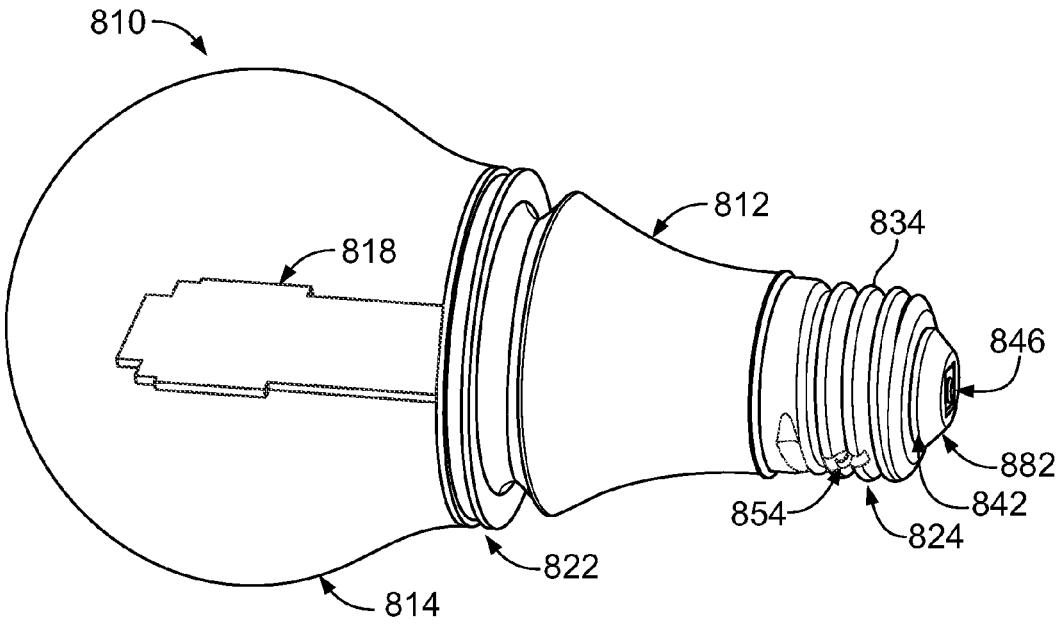
FIG. 20 is a perspective view of another embodiment of a light emitting diode (LED) bulb assembly.

FIG. 20 is a perspective view of another embodiment of an LED bulb assembly 810. The assembly 810 includes a bulb housing 812 and an LED bulb 814 held by the bulb housing 812. The bulb housing 812 is configured to be threadably connected to a complementary light bulb socket (not shown; e.g., the light bulb socket 13 shown in FIG. 1 and/or the light bulb socket 713 shown in FIGS. 17 and 19). The LED bulb 814 includes a PCB 818. The assembly 810 includes an electrical connector 820 (FIGS. 21 and 22) for electrically connecting the PCB 818 to the complementary light bulb socket. The electrical connector 820 enables the PCB 818 to be electrically connected to the complementary light bulb socket without using any electrical wires (not shown) in the electrical path from the PCB 818 to the complementary light bulb socket.

The bulb housing 812 extends a length from a bulb end 822 to a socket end 824 that is opposite the bulb end 822. The LED bulb 814 is mounted to the bulb end 822 of the bulb housing 812. The bulb housing 812 is configured to be connected to the complementary light bulb socket at the socket end 824.

In the illustrated embodiment, the bulb housing 812 includes an exterior thread 834 at the socket end 824 that is configured to be threadably connected to the complementary light bulb socket. The socket end 824 of the bulb housing 812 may replace a standard Edison screw fitting and/or other standard fitting (i.e., base) for light bulbs that is configured to be mounted to a standard and complementary sized light bulb socket (e.g., the light bulb socket 713). As will be described below, a negative contact 854 of the electrical connector 820 defines a negative terminal of the LED bulb assembly 810. Specifically, the negative contact 854 is configured to mate with a corresponding negative terminal (not shown; e.g., the negative terminal 717 shown in FIGS. 17 and 19) of the complementary light bulb socket to provide a negative electrical connection between the LED bulb assembly 810 (and more specifically the PCB 818) and the complementary light bulb socket.

The LED bulb assembly 810 includes a mating connector 882 that is configured to mate with the electrical connector 820 to electrically connect the PCB 818 to a positive terminal 846 of the LED bulb assembly 810. The mating connector 882 includes the positive terminal 846 of the LED bulb assembly 810. Specifically, the mating connector 882 includes an insulator 842 that holds the positive terminal 846 of the LED bulb assembly 810. The positive terminal 846 is configured to mate with a corresponding positive terminal (not shown; e.g., the positive terminal 719 shown in FIGS. 17 and 19) of the complementary light bulb socket to provide a positive electrical connection between the LED bulb assembly 810 (and more specifically the PCB 818) and the light bulb socket. The positive terminal 846 replaces the standard positive terminal of a standard Edison screw base (i.e., fitting) for light bulbs. The positive terminal 846 may be considered a component of the assembly 810 and/or the mating connector 882.

In the illustrated embodiment, the insulator 842 is formed as a single, unitary body with at least a portion of the bulb housing 812, as is shown in FIG. 20.

The socket end 824 of the bulb housing 812 is not limited to being a screw fitting that threadably connects to the complementary light bulb socket. Rather, the socket end 824 of the bulb housing 812 may have any other structure for replacing any other type of light bulb base that connects to the complementary light bulb socket with any other type of connection, such as, but not limited to, a bayonet base that is configured to connect to a complementary light bulb socket with a bayonet style connection, and/or the like.

Figure 21:
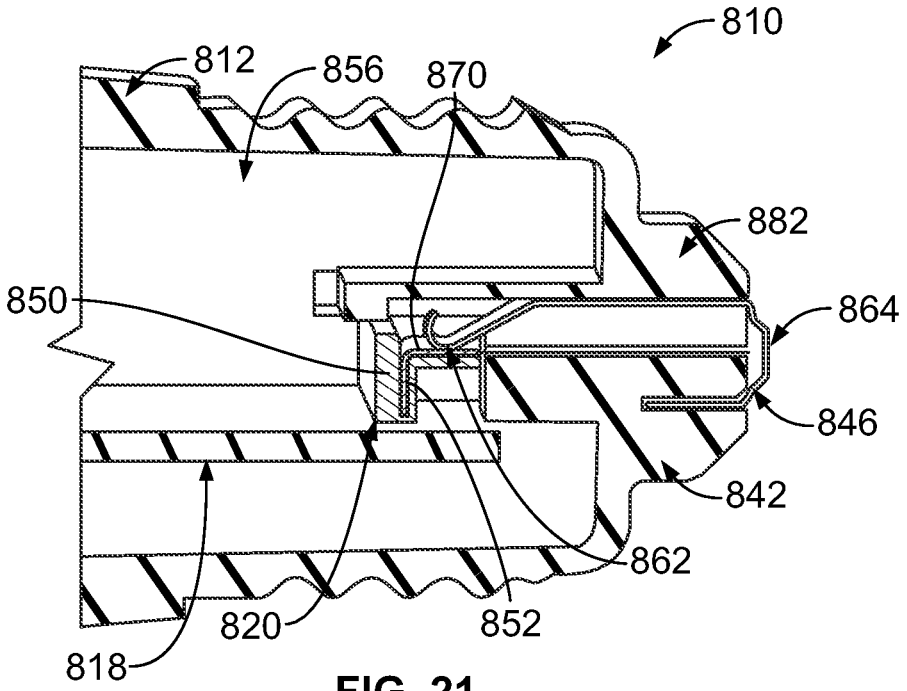
FIG. 21 is a perspective view illustrating a cross section of a portion of the LED bulb assembly shown in FIG. 20.

FIG. 21 is a perspective view illustrating a cross section of a portion of the LED bulb assembly 810. The electrical connector 820 of the LED bulb assembly 810 is mounted to the PCB 818. The electrical connector 820 includes a connector housing 850, a positive contact 852 held by the connector housing 850, and the negative contact 854 (FIGS. 20 and 22), which is held by the connector housing 850. The positive contact 852 is configured to mate with the positive terminal 846.

The bulb housing 812 includes an interior cavity 856 within which at least a portion of the PCB 818 extends. The electrical connector 820 is mounted to the PCB 818 such that the positive contact 852 and the negative contact 854 are each electrically connected to the PCB 818. Each contact 852 and 854 may be electrically connected to the PCB 818 using any method, means, structure, mounting type, and/or the like. Examples of structures of the contact 852 and/or the contact 854 include, but are not limited to, one or more press-fit pins (not shown; e.g., eye-of-the needle pins and/or the like), one or more solder posts (not shown), one or more surface mount members (not shown), and/or the like.

The mating connector 882 includes the insulator 842 and the positive terminal 846. The positive terminal 846 is held by the insulator 842. The positive terminal 846 includes a connector mating end 862 and a socket mating end 864. When the connectors 820 and 882 are mated together as shown in FIG. 21, the connector mating end 862 of the positive terminal 846 is mated in electrical contact with the positive contact 852 of the electrical connector 820. Specifically, the connector mating end 862 of the positive terminal 846 is engaged in physical contact with, and thereby electrically connected to, the positive contact 852. The electrical connection between the positive contact 852 of the electrical connector 820 and the positive terminal 846 of the mating connector 882 provides the positive electrical connection between the PCB 818 and the positive terminal 846.

The positive contact 852 may have any structure that enables the positive contact 852 to mate with the connector mating end 862 of the positive terminal 846. In the illustrated embodiment, the positive contact 852 includes a blade 870 that engages the connector mating end 862 of the positive terminal 846 to establish the electrical contact between the positive terminal 846 and the positive contact 852. Examples of other suitable structures of the positive contact 852 for mating with the positive terminal 846 include, but are not limited to, a spring finger, a socket, a spring arm, a pin, a card edge, and/or the like. Although one are shown, the positive contact 852 may include any number of the blades 870. As can be seen in FIG. 21, the socket mating end 864 of the positive terminal 846 is exposed for mating with the corresponding positive terminal of the complementary light bulb socket. When the positive terminal 846 is mated with the corresponding positive terminal of the complementary light bulb socket, the electrically connection therebetween provides a positive electrical connection between the LED bulb assembly 810 (and more specifically the PCB 818) and the complementary light bulb socket.

Figure 22:
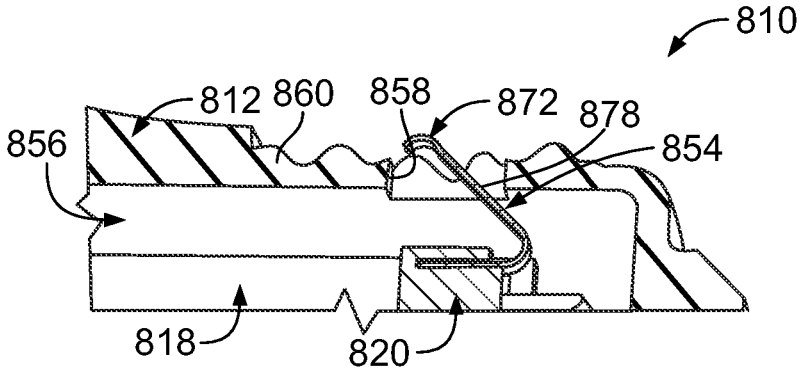
FIG. 22 is a perspective view illustrating another cross section of a portion of the LED bulb assembly shown in FIGS. 20 and 21.

FIG. 22 is a perspective view illustrating another cross section of a portion of the LED bulb assembly 810. The bulb housing 812 includes one or more thru openings 858 that extend through a wall 860 of the bulb housing 812 into communication with the interior cavity 856. The thru opening 858 enables the negative contact 854 to extend through the wall 860 into engagement in physical contact with the corresponding negative terminal (not shown; e.g., the negative terminal 717 shown in FIGS. 17 and 19) of the complementary light bulb socket (not shown; e.g., the light bulb socket 13 shown in FIG. 1 or the light bulb socket 713 shown in FIGS. 17 and 19).

As briefly described above, the negative contact 854 of the electrical connector 820 defines a negative terminal of the LED bulb assembly 810 that is configured to mate with the corresponding negative terminal of the complementary light bulb socket. The negative contact 854 may have any structure that enables the negative contact 854 to mate with the corresponding negative terminal of the complementary light bulb socket. In the illustrated embodiment, the negative contact 854 includes a spring arm 878. Examples of other suitable structures of the negative contact 854 for mating with the corresponding negative terminal include, but are not limited to, a blade, a tab, a finger, and/or the like. Although one is shown, the negative contact 854 may include any number of the spring arms 878.

When the bulb housing 812 is connected to the complementary light bulb socket, a mating end 872 of the negative contact 854 extends through the thru opening 858 within the wall 860 of the bulb housing 812 such that the mating end 872 engages in physical contact with, and thereby electrically connects to, the corresponding negative terminal of the complementary light bulb socket. The negative contact 854 defines a negative terminal of the LED bulb assembly 810. Specifically, the electrical connection between the negative contact 854 of the electrical connector 820 and the corresponding negative terminal of the complementary light bulb socket provides the negative electrical connection between LED bulb assembly 810, and more specifically the PCB 818, and the light bulb socket.

The positive and negative electrical connections provided by the positive and negative contacts 852 and 854, respectively, of the electrical connector 820 enable the LED bulb assembly 810 to be electrically connected to the complementary light bulb socket. The electrical connectors 820 and 882 enable the PCB 818 to be electrically connected to the complementary light bulb socket without using any electrical wires (not shown) in the electrical path from the PCB 818 to the complementary light bulb socket. The bulb housing 812 may replace a standard Edison screw fitting and/or other standard fitting (i.e., base) for light bulbs. The LED bulb assembly 810 may eliminate solder connections between electrical wires and a standard fitting (e.g., between the electrical wires and a shell [e.g., the threaded shell 32 shown in FIGS. 1-3] of a standard fitting and/or between the electrical wires and the positive terminal 846). The LED bulb assembly 810 may be less time consuming to manufacture than at least some known LED bulb assemblies. The LED bulb assembly 810 may be more easily manufactured without or with less quality defects than at least some known LED bulb assemblies.

Figure 23:
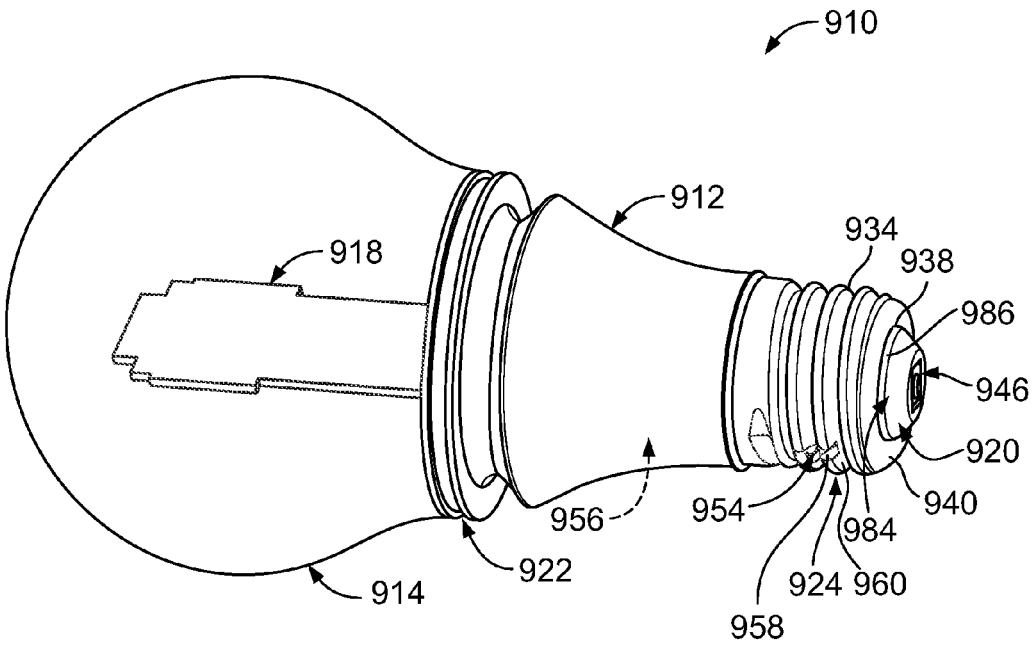
FIG. 23 is a perspective view of another embodiment of an LED bulb assembly.

FIG. 23 is a perspective view of another embodiment of an LED bulb assembly 910. The assembly 910 includes a bulb housing 912 and an LED bulb 914 held by the bulb housing 912. The bulb housing 912 is configured to be threadably connected to a complementary light bulb socket (not shown; e.g., the light bulb socket 13 shown in FIG. 1 and/or the light bulb socket 713 shown in FIGS. 17 and 19). The LED bulb 914 includes a PCB 918. The assembly 910 includes an electrical connector 920 for electrically connecting the PCB 918 to the complementary light bulb socket. The electrical connector 920 enables the PCB 918 to be electrically connected to the complementary light bulb socket without using any electrical wires (not shown) in the electrical path from the PCB 918 to the light bulb socket.

The bulb housing 912 extends a length from a bulb end 922 to a socket end 924 that is opposite the bulb end 922. The LED bulb 914 is mounted to the bulb end 922 of the bulb housing 912. The bulb housing 912 is configured to be connected to the complementary light bulb socket at the socket end 924.

In the illustrated embodiment, the bulb housing 912 includes an exterior thread 934 at the socket end 924 that is configured to be threadably connected to the complementary light bulb socket. The socket end 924 of the bulb housing 912 may replace a standard Edison screw fitting and/or other standard fitting (i.e., base) for light bulbs that is configured to be mounted to a standard and complementary sized light bulb socket (e.g., the light bulb socket 713). As will be described below, a negative terminal 954 of the LED bulb assembly 910 is configured to mate with a corresponding negative terminal (not shown; e.g., the negative terminal 717 shown in FIGS. 17 and 19) of the complementary light bulb socket to provide a negative electrical connection between the LED bulb assembly 910 (and more specifically the PCB 918) and the complementary light bulb socket.

The socket end 924 of the bulb housing 912 includes a thru opening 938 that extends through an end wall 940 of the bulb housing 912 for receiving a plug 984 of the electrical connector 920. The thru opening 938 is better seen in FIG. 25.

The bulb housing 912 includes an interior cavity 956 within which at least a portion of the PCB 918 extends. The bulb housing 912 includes one or more thru openings 958 that extend through a wall 960 of the bulb housing 912 into communication with the interior cavity 956. The thru opening 958 enables the negative terminal 954 to extend through the wall 960 into engagement in physical contact with the corresponding negative terminal of the complementary light bulb socket.

The positive terminal 946 is configured to mate with a corresponding positive terminal (not shown; e.g., the positive terminal 719 shown in FIGS. 17 and 19) of the complementary light bulb socket to provide a positive electrical connection between the LED bulb assembly 910 (and more specifically the PCB 918) and the light bulb socket. The positive terminal 946 replaces the standard positive terminal of a standard Edison screw base (i.e., fitting) for light bulbs. The positive terminal 946 may be considered a component of the assembly 910 and/or the electrical connector 920.

The socket end 924 of the bulb housing 912 is not limited to being a screw fitting that threadably connects to the complementary light bulb socket. Rather, the socket end 924 of the bulb housing 912 may have any other structure for replacing any other type of light bulb base that connects to the complementary light bulb socket with any other type of connection, such as, but not limited to, a bayonet base that is configured to connect to a complementary light bulb socket with a bayonet style connection, and/or the like.

Figure 24:
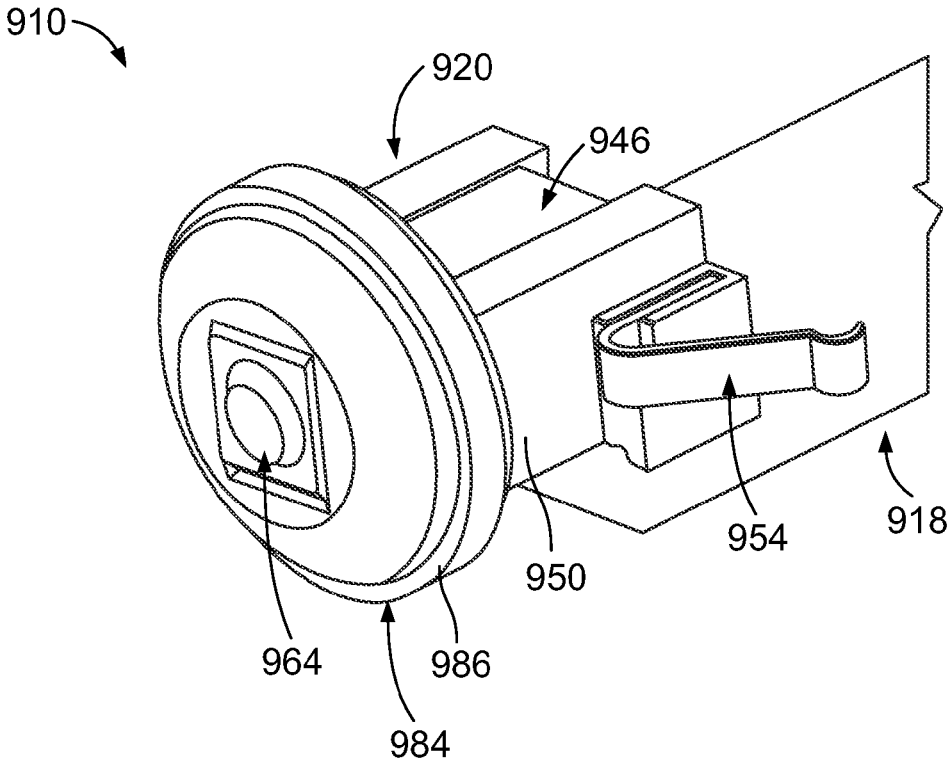
FIG. 24 is a perspective view of an embodiment of a printed circuit board (PCB) and an embodiment of an electrical connector of the LED bulb assembly shown in FIG. 24 illustrating the electrical connector mounted to the PCB.

FIG. 24 is a perspective view of the PCB 918 and the electrical connector 920 mounted to the PCB 918. The electrical connector 920 includes a connector housing 950, the negative terminal 954 (which is held by the connector housing 950), and the positive terminal 946 of the LED bulb assembly 910. As can be seen in FIG. 24, the positive terminal 946 is held by the connector housing 950. The positive terminal 946 replaces the standard positive terminal of a standard Edison screw base (i.e., fitting) for light bulbs.

The connector housing 950 of the electrical connector 920 includes an electrically insulative plug 984 that includes an end face 986. The plug 984 is configured to be held by the bulb housing 912 (FIGS. 23 and 25) such that the plug 984 extends within the thru opening 938 (FIGS. 23 and 25) of the bulb housing 912.

The electrical connector 920 is mounted to the PCB 918 such that the positive terminal 946 and the negative terminal 954 are each electrically connected to the PCB 918. Each of the positive terminal 946 and the negative terminal 954 may be electrically connected to the PCB 918 using any method, means, structure, mounting type, and/or the like. Examples of structures of the positive terminal 946 and/or the negative terminal 954 include, but are not limited to, one or more press-fit pins (not shown; e.g., eye-of-the needle pins and/or the like), one or more solder posts (not shown), one or more surface mount members (not shown), and/or the like.

As can be seen in FIG. 24, the positive terminal 946 is held by the connector housing 950 such that a socket mating end 964 of the positive terminal 946 is held by, and exposed along, the plug 984 of the connector housing 950. Referring again to FIG. 23, the plug 984 of the connector housing 950 extends within the thru opening 938 of the bulb housing 912. The end face 986 of the plug 984 is optionally configured to seal the thru opening 938. The socket mating end 964 of the positive terminal 946 is exposed for mating with the corresponding positive terminal (not shown; e.g., the positive terminal 719 shown in FIGS. 17 and 19) of the complementary light bulb socket (not shown; e.g., the light bulb socket 13 shown in FIG. 1 and/or the light bulb socket 713 shown in FIGS. 17 and 19). When the positive terminal 946 is mated with the corresponding positive terminal of the complementary light bulb socket, the electrically connection therebetween provides a positive electrical connection between the LED bulb assembly 910 (and more specifically the PCB 918) and the complementary light bulb socket.

Figure 25:
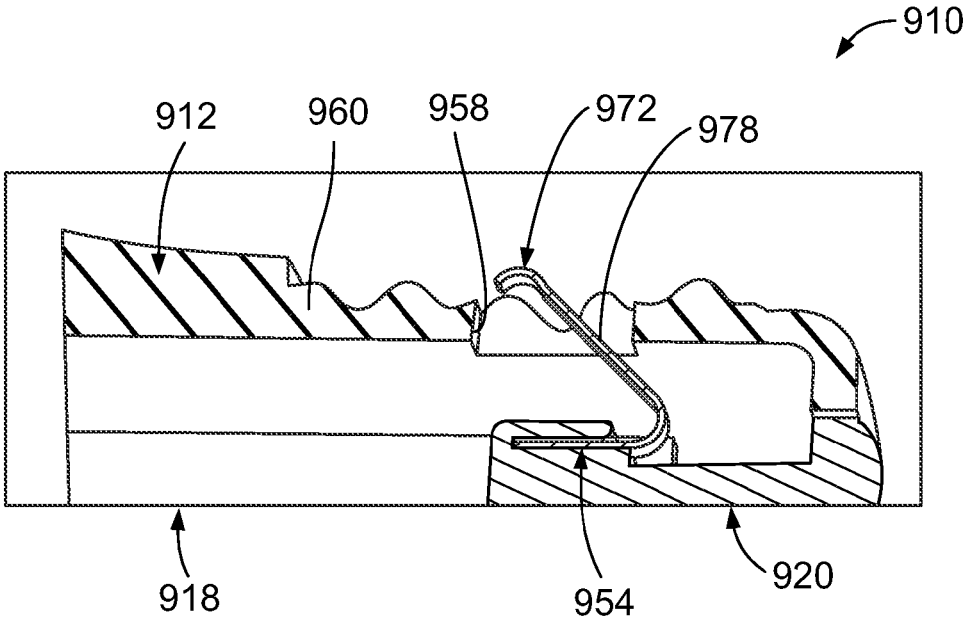
FIG. 25 is a perspective view illustrating a cross section of a portion of the LED bulb assembly shown in FIGS. 23 and 24.

FIG. 25 is a perspective view illustrating a cross section of a portion of the LED bulb assembly 910. The negative terminal 954 of the electrical connector 920 is configured to mate with the corresponding negative terminal (not shown; e.g., the negative terminal 717 shown in FIGS. 17 and 19) of the complementary light bulb socket (not shown; e.g., the light bulb socket 13 shown in FIG. 1 and/or the light bulb socket 713 shown in FIGS. 17 and 19).

The negative terminal 954 may have any structure that enables the negative terminal 954 to mate with the corresponding negative terminal of the complementary light bulb socket. In the illustrated embodiment, the negative terminal 954 includes a spring arm 978. Examples of other suitable structures of the negative terminal 954 for mating with the corresponding negative terminal include, but are not limited to, a blade, a tab, a finger, and/or the like. Although one is shown, the negative terminal 954 may include any number of the spring arms 978.

When the bulb housing 912 is connected to the complementary light bulb socket, a mating end 972 of the negative terminal 954 extends through the thru opening 958 within the wall 960 of the bulb housing 912 such that the mating end 972 engages in physical contact with, and thereby electrically connects to, the corresponding negative terminal of the complementary light bulb socket. The electrical connection between the negative terminal 954 of the electrical connector 920 and the corresponding negative terminal of the complementary light bulb socket provides the negative electrical connection between LED bulb assembly 910, and more specifically the PCB 918, and the light bulb socket.

The positive and negative electrical connections provided by the positive terminal 946 and the negative terminal 954, respectively, of the electrical connector 920 enable the LED bulb assembly 910 to be electrically connected to the complementary light bulb socket. The electrical connector 920 enables the PCB 918 to be electrically connected to the complementary light bulb socket without using any electrical wires (not shown) in the electrical path from the PCB 918 to the complementary light bulb socket. The bulb housing 912 may replace a standard Edison screw fitting and/or other standard fitting (i.e., base) for light bulbs. The LED bulb assembly 910 may eliminate solder connections between electrical wires and a standard fitting (e.g., between the electrical wires and a shell [e.g., the threaded shell 32 shown in FIGS. 1-3] of a standard fitting and/or between the electrical wires and the positive terminal 946). The LED bulb assembly 910 may be less time consuming to manufacture than at least some known LED bulb assemblies. The LED bulb assembly 910 may be more easily manufactured without or with less quality defects than at least some known LED bulb assemblies.

Figure 26:
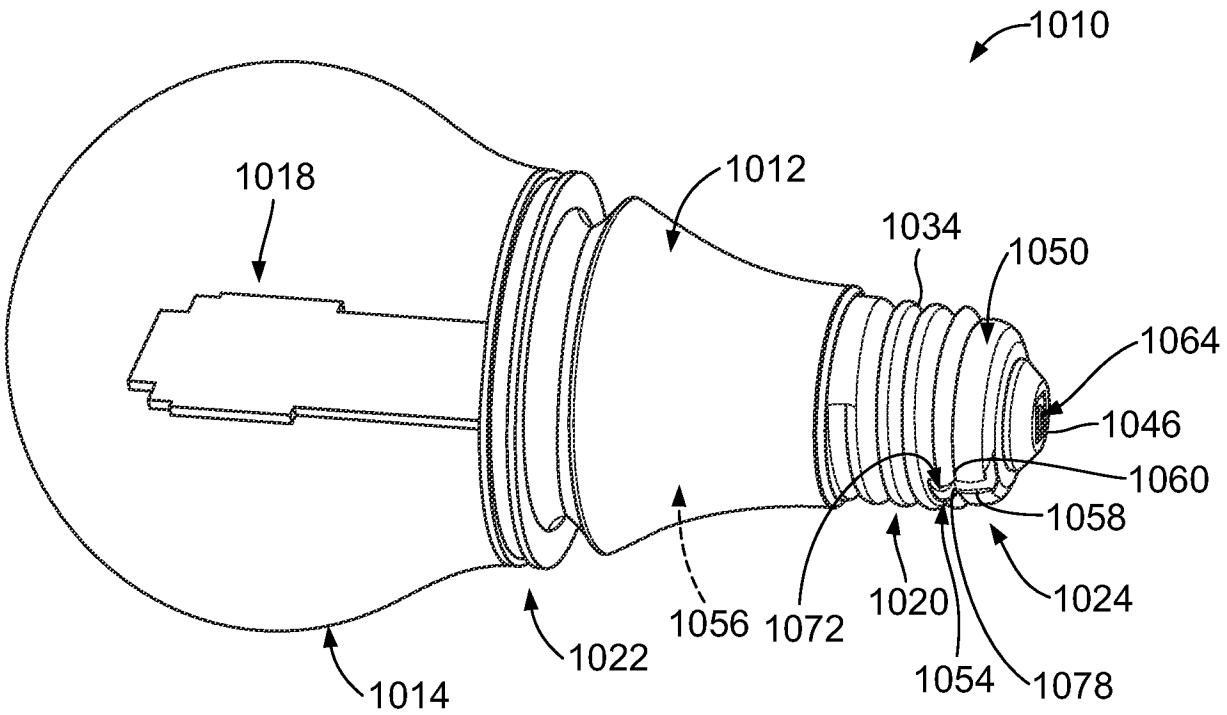
FIG. 26 is a perspective view of another embodiment of an LED bulb assembly.
Figure 27:
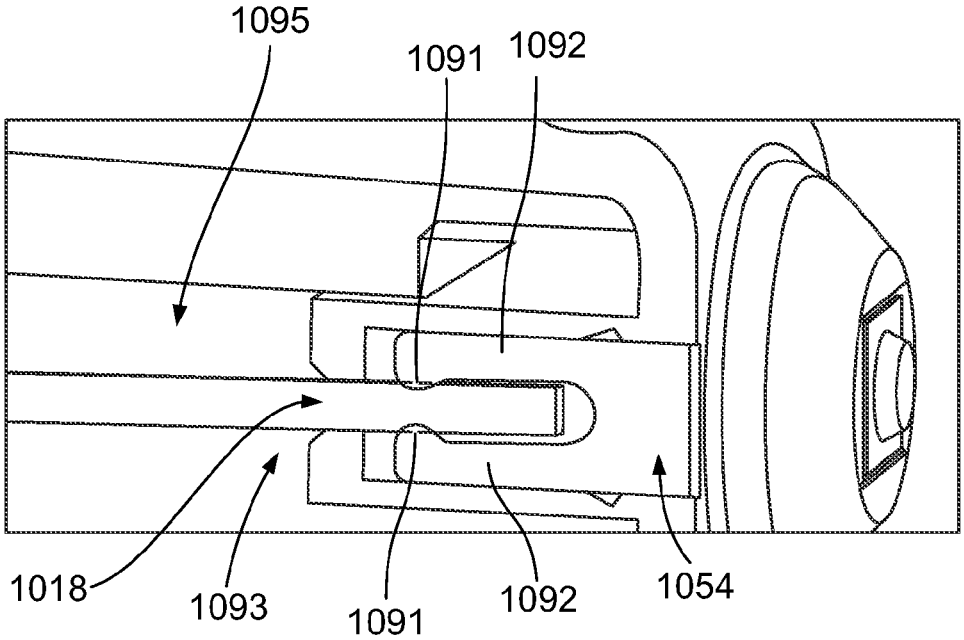
FIG. 27 is a perspective view illustrating a cross section of a portion of the LED bulb assembly shown in FIG. 26.

FIG. 26 is a perspective view of another embodiment of an LED bulb assembly 1010. The assembly 1010 includes a bulb housing 1012 and an LED bulb 1014 held by the bulb housing 1012. The bulb housing 1012 is configured to be threadably connected to a complementary light bulb socket (not shown; e.g., the light bulb socket 13 shown in FIG. 1 and/or the light bulb socket 713 shown in FIGS. 17 and 19). The LED bulb 1014 includes a PCB 1018. The assembly 1010 includes an electrical connector 1020 for electrically connecting the PCB 1018 to the complementary light bulb socket. The electrical connector 1020 enables the PCB 1018 to be electrically connected to the complementary light bulb socket without using any electrical wires (not shown) in the electrical path from the PCB 1018 to the light bulb socket.

The bulb housing 1012 extends a length from a bulb end 1022 to a socket end 1024 that is opposite the bulb end 1022. The LED bulb 1014 is mounted to the bulb end 1022 of the bulb housing 1012. The bulb housing 1012 is configured to be connected to the complementary light bulb socket at the socket end 1024.

In the illustrated embodiment, the bulb housing 1012 includes an exterior thread 1034 at the socket end 1024 that is configured to be threadably connected to the complementary light bulb socket. The socket end 1024 of the bulb housing 1012 may replace a standard Edison screw fitting and/or other standard fitting (i.e., base) for light bulbs that is configured to be mounted to a standard and complementary sized light bulb socket (e.g., the light bulb socket 713). As will be described below, a negative terminal 1054 of the electrical connector 1020 defines a negative terminal of the LED bulb assembly 1010 that is configured to mate with a corresponding negative terminal (not shown; e.g., the negative terminal 717 shown in FIGS. 17 and 19) of the complementary light bulb socket to provide a negative electrical connection between the LED bulb assembly 1010 (and more specifically the PCB 1018) and the complementary light bulb socket.

The bulb housing 1012 includes an interior cavity 1056 within which at least a portion of the PCB 1018 extends. The bulb housing 1012 includes one or more thru openings 1058 that extend through a wall 1060 of the bulb housing 1012 into communication with the interior cavity 1056. The thru opening 1058 enables the negative terminal 1054 to extend through the wall 1060 into engagement in physical contact with the corresponding negative terminal of the complementary light bulb socket.

A positive terminal 1046 of the LED bulb assembly 1010 is configured to mate with a corresponding positive terminal (not shown; e.g., the positive terminal 719 shown in FIGS. 17 and 19) of the complementary light bulb socket to provide a positive electrical connection between the LED bulb assembly 1010 (and more specifically the PCB 1018) and the light bulb socket. The positive terminal 1046 replaces the standard positive terminal of a standard Edison screw base (i.e., fitting) for light bulbs. The positive terminal 1046 may be considered a component of the assembly 1010 and/or the electrical connector 1020.

The socket end 1024 of the bulb housing 1012 is not limited to being a screw fitting that threadably connects to the complementary light bulb socket. Rather, the socket end 1024 of the bulb housing 1012 may have any other structure for replacing any other type of light bulb base that connects to the complementary light bulb socket with any other type of connection, such as, but not limited to, a bayonet base that is configured to connect to a complementary light bulb socket with a bayonet style connection, and/or the like.

The electrical connector 1020 includes a connector housing 1050, the negative terminal 1054 (which is held by the connector housing 1050), and the positive terminal 1046 of the LED bulb assembly 1010. As can be seen in FIG. 26, the positive terminal 1046 is held by the connector housing 1050. In the embodiment of FIG. 26, the connector housing 1050 is formed as a single, unitary body with at least a portion of the bulb housing 1012.

As can be seen in FIG. 26, the positive terminal 1046 is held by the connector housing 1050 such that a socket mating end 1064 of the positive terminal 1046 is held by, and exposed along, the connector housing 1050 at the socket end 1024 of the bulb housing 1012. The socket mating end 1064 of the positive terminal 1046 is exposed for mating with the corresponding positive terminal of the complementary light bulb socket. When the positive terminal 946 is mated with the corresponding positive terminal of the complementary light bulb socket, the electrically connection therebetween provides a positive electrical connection between the LED bulb assembly 1010 (and more specifically the PCB 1018) and the complementary light bulb socket.

Figure 28:
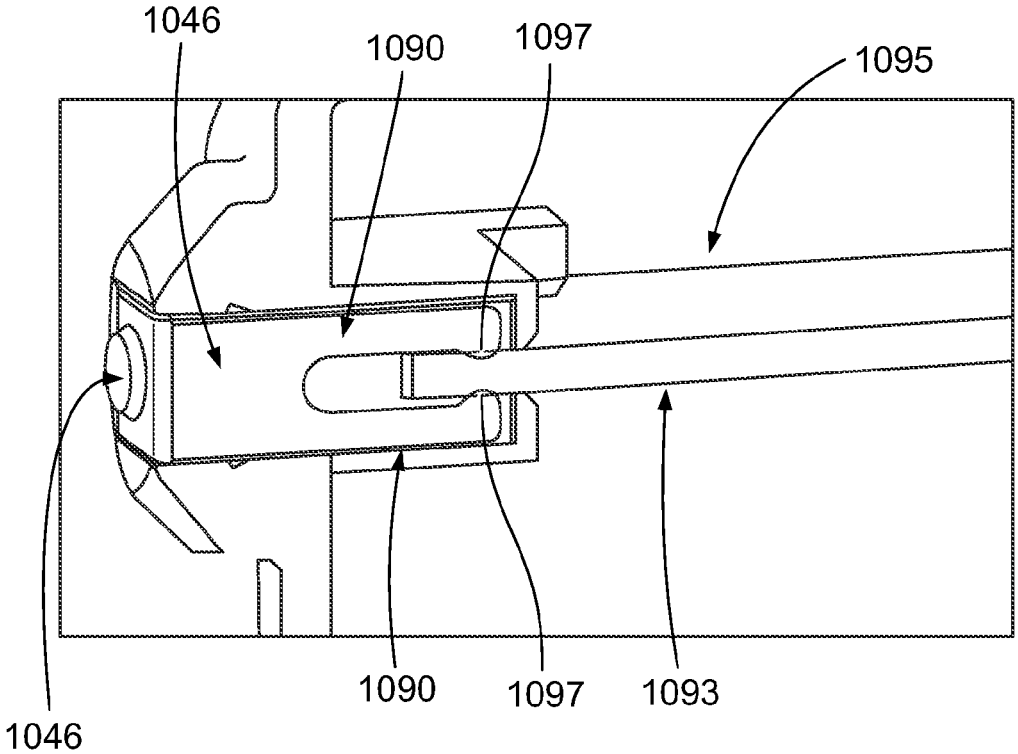
FIG. 28 is a perspective view illustrating another cross section of a portion of the LED bulb assembly shown in FIGS. 26 and 27.

Each of the positive terminal 1046 and the negative terminal 1054 may be electrically connected to the PCB 1018 using any method, means, structure, mounting type, and/or the like. In the illustrated embodiment, the positive terminal 1046 and the negative terminal 1054 each include one or more pairs of opposing spring arms that engage the PCB 1018 therebetween to electrically connect the positive terminal 1046 and the negative terminal 1054 to the PCB 1018. For example, and referring now to FIG. 27, opposing spring arms 1092 of the negative terminal 1054 engage corresponding contact pads 1091 on opposite sides 1093 and 1095 of the PCB 1018 to electrically connect the negative terminal 1054 to the PCB 518. The negative terminal 1054 may include any number of pairs of the spring arms 1092 and any number of spring arms 1092 overall. As shown in FIG. 28, opposing spring arms 1090 of the positive terminal 1046 engage corresponding contact pads 1097 on the opposite sides 1093 and 1095 of the PCB 1018 to electrically connect the positive terminal 1046 to the PCB 1018. The positive terminal 1046 may include any number of pairs of the spring arms 1090 and any number of spring arms 1090 overall.

Referring again to FIG. 26, the negative terminal 1054 is configured to mate with the corresponding negative terminal (not shown; e.g., the negative terminal 717 shown in FIGS. 17 and 19) of the complementary light bulb socket (not shown; e.g., the light bulb socket 13 shown in FIG. 1 and/or the light bulb socket 713 shown in FIGS. 17 and 19). The negative terminal 1054 may have any structure that enables the negative terminal 1054 to mate with the corresponding negative terminal of the complementary light bulb socket. In the illustrated embodiment, the negative terminal 1054 includes a spring arm 1078. Examples of other suitable structures of the negative terminal 1054 for mating with the corresponding negative terminal include, but are not limited to, a blade, a tab, a finger, and/or the like. Although one is shown, the negative terminal 1054 may include any number of the spring arms 1078.

When the bulb housing 1012 is connected to the complementary light bulb socket, a mating end 1072 of the negative terminal 1054 extends through the thru opening 1058 within the wall 1060 of the bulb housing 1012 such that the mating end 1072 engages in physical contact with, and thereby electrically connects to, the corresponding negative terminal of the complementary light bulb socket. The electrical connection between the negative terminal 1054 of the electrical connector 1020 and the corresponding negative terminal of the complementary light bulb socket provides the negative electrical connection between LED bulb assembly 1010, and more specifically the PCB 1018, and the light bulb socket.

The positive and negative electrical connections provided by the positive terminal 1046 and the negative terminal 1054, respectively, of the electrical connector 1020 enable the LED bulb assembly 1010 to be electrically connected to the complementary light bulb socket. The electrical connector 1020 enables the PCB 1018 to be electrically connected to the complementary light bulb socket without using any electrical wires (not shown) in the electrical path from the PCB 1018 to the complementary light bulb socket. The bulb housing 1012 may replace a standard Edison screw fitting and/or other standard fitting (i.e., base) for light bulbs. The LED bulb assembly 1010 may eliminate solder connections between electrical wires and a standard fitting (e.g., between the electrical wires and a shell [e.g., the threaded shell 32 shown in FIGS. 1-3] of a standard fitting and/or between the electrical wires and the positive terminal 1046). The LED bulb assembly 1010 may be less time consuming to manufacture than at least some known LED bulb assemblies. The LED bulb assembly 1010 may be more easily manufactured without or with less quality defects than at least some known LED bulb assemblies.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A light bulb assembly comprising:

a bulb housing that is configured to be connected to a light bulb socket;

a light bulb held by the bulb housing and comprising a printed circuit board (PCB); and an electrical connector comprising a connector housing, a negative terminal of the light bulb assembly, and a positive terminal of the light bulb assembly, the positive terminal and the negative terminal being held by the connector housing, the electrical connector being mounted to the PCB such that the positive terminal and the negative terminal are electrically connected to the PCB, wherein the negative terminal is configured to mate with a corresponding negative terminal of the light bulb socket and the positive terminal is configured to mate with a corresponding positive terminal of the light bulb socket, wherein the negative terminal of the light bulb assembly comprises a spring arm that is configured to engage in physical contact with the corresponding negative terminal of the light bulb socket to electrically connect the negative terminal of the light bulb assembly with the corresponding negative terminal of the light bulb socket.

2. The light bulb assembly of claim 1, wherein the connector housing comprises an electrically insulative plug having an end face that is configured to seal a thru opening of the bulb housing.

3. The light bulb assembly of claim 1, wherein the connector housing comprises an electrically insulative plug that is configured to extend within a thru opening of the bulb housing, the positive terminal of the light bulb assembly comprising a mating end that is held by the plug such that the mating end is exposed at the thru opening for mating with the corresponding positive terminal of the light bulb socket.

4. The light bulb assembly of claim 1, wherein the positive terminal of the light bulb assembly comprises a mounting end and a mating end, the mounting end being mounted to the PCB to electrically connect the positive terminal of the light bulb assembly to the PCB, the mating end being exposed for mating with the corresponding positive terminal of the light bulb socket.

5. The light bulb assembly of claim 1, wherein the connector housing is formed as a single, unitary body with at least a portion of the bulb housing.

6. The light bulb assembly of claim 1, wherein the positive terminal of the light bulb assembly comprises at least one of a solder post, a surface mount member, or a press-fit pin that is mounted to the PCB to electrically connect the positive terminal of the light bulb assembly to the PCB, the negative terminal of the light bulb assembly comprising at least one of a solder post, a surface mount member, or a press-fit pin that is mounted to the PCB to electrically connect the negative terminal of the light bulb assembly to the PCB.

7. The light bulb assembly of claim 1, wherein at least one of the positive terminal of the light bulb assembly or the negative terminal of the light bulb assembly comprises a spring arm that is engaged in physical contact with the PCB to electrically connect the at least one of the positive terminal of the light bulb assembly or the negative terminal of the light bulb assembly to the PCB.

8. The light bulb assembly of claim 1, wherein the light bulb comprises a light emitting diode (LED) light bulb that comprises an LED.

9. The light bulb assembly of claim 1, wherein the bulb housing comprises a thread that is configured to be threadably received within the light bulb socket to connect the bulb housing to the light bulb socket.

10. A light bulb assembly comprising:

a bulb housing that is configured to be connected to a light bulb socket;

a positive terminal configured to be held by the bulb housing, the positive terminal of the light bulb assembly being configured to mate with a corresponding positive terminal of the light bulb socket;

a light bulb held by the bulb housing and comprising a printed circuit board (PCB); and an electrical connector comprising a connector housing, a positive contact held by the connector housing, and a negative terminal held by the connector housing, the electrical connector being mounted to the PCB such that the positive contact and the negative terminal are electrically connected to the PCB, wherein the positive contact is configured to mate with the positive terminal and the negative terminal of the electrical connector of the light bulb assembly is configured to mate with a corresponding negative terminal of the light bulb socket, and wherein the positive terminal of the light bulb assembly comprises a pin that is configured to extend through an opening of the bulb housing into an interior cavity of the bulb housing such that a connector mating end of the pin mates with the positive contact of the electrical connector.

11. The light bulb assembly of claim 10, wherein the positive terminal of the light bulb assembly comprises a pin that is configured to be held by the bulb housing such that a connector mating end of the pin is mated with the positive contact of the electrical connector and such that a socket mating end of the pin is exposed for mating with the corresponding positive terminal of the light bulb socket.

12. The light bulb assembly of claim 10, further comprising a mating connector that includes the positive terminal of the light bulb assembly, wherein the mating connector is configured to mate with the electrical connector such that the positive terminal of the light bulb assembly and the positive contact are in electrical contact with each other.

13. The light bulb assembly of claim 10, further comprising a mating connector that includes the positive terminal of the light bulb assembly, wherein the mating connector includes an insulator that holds the positive terminal of the light bulb assembly and is formed as a single, unitary body with at least a portion of the bulb housing.

14. The light bulb assembly of claim 10, wherein the negative terminal of the light bulb assembly comprises a spring arm that is configured to engage in physical contact with the corresponding negative terminal of the light bulb socket to electrically connect the negative terminal of the light bulb assembly with the corresponding negative terminal of the light bulb socket.

15. The light bulb assembly of claim 10, wherein the positive contact comprises at least one of a solder post, a surface mount member, or a press-fit pin that is mounted to the PCB to electrically connect the positive contact to the PCB, the negative terminal of the light bulb assembly comprising at least one of a solder post, a surface mount member, or a press-fit pin that is mounted to the PCB to electrically connect the negative terminal of the light bulb assembly to the PCB.

16. The light bulb assembly of claim 10, wherein the bulb housing comprises a thread that is configured to be threadably received within the light bulb socket to connect the bulb housing to the light bulb socket.

17. A light bulb assembly comprising:

a bulb housing that is configured to be connected to a light bulb socket;

a light bulb held by the bulb housing and comprising a printed circuit board (PCB);

a negative terminal mounted to the PCB such that the negative terminal is electrically connected to the PCB, the negative terminal comprising a spring arm that is configured to engage in physical contact with a corresponding negative terminal of the light bulb socket at a separable interface; and a positive terminal extending a length from a mounting end to a mating end, the mounting end being mounted to the PCB to electrically connect the positive terminal to the PCB, wherein the mating end is configured to mate with a corresponding positive terminal of the light bulb socket.

18. The light bulb assembly of claim 1, wherein the bulb housing includes a thru opening extending through a wall of the bulb housing, the spring arm of the negative terminal extending from within the bulb housing through the thru opening to engage the corresponding negative terminal of the light bulb socket exterior of the bulb housing at a separable interface.

19. The light bulb assembly of claim 17, wherein the bulb housing includes a thru opening extending through a wall of the bulb housing, the spring arm of the negative terminal extending from within the bulb housing through the thru opening to engage the corresponding negative terminal of the light bulb socket exterior of the bulb housing at a separable interface.

20. The light bulb assembly of claim 17, wherein the bulb housing extends a length from a bulb end to an opposite socket end, the light bulb being mounted to the bulb end of the bulb housing, the PCB of the light bulb extending through the bulb housing towards the socket end, a first end of the PCB being disposed outside of the bulb end of the bulb housing, a second end of the PCB being disposed within the bulb housing at least proximate to the socket end, the light bulb comprising an LED electrically connected to the PCB at least proximate to the first end of the PCB, the negative and positive terminals of the light bulb assembly being mounted to the PCB at least proximate to the second end of the PCB.

* * * * *